US006132916A

United States Patent [19]

Ueda et al.

[11] Patent Number: 6,132,916

[45] Date of Patent: Oct. 17, 2000

[54] TONER FOR DEVELOPING ELECTROSTATIC LATENT IMAGES

[75] Inventors: Hideaki Ueda, Kishiwada; Keiichi Furukawa, Suita, both of Japan

[73] Assignee: Minolta Co., Ltd., Osaka, Japan

[21] Appl. No.: 08/968,581

[22] Filed: Nov. 13, 1997

[30] Foreign Application Priority Data

Nov. 21, 1996 [JP] Japan ..... 8-310258
Nov. 28, 1996 [JP] Japan ..... 8-317212

[51] Int. Cl.[7] ..... G03G 9/097

[52] U.S. Cl. ..... 430/106; 430/110

[58] Field of Search ..... 430/110, 106

[56] References Cited

U.S. PATENT DOCUMENTS

| | | | |
|---|---|---|---|
| 4,147,645 | 4/1979 | Lu | 252/62.1 |
| 4,411,975 | 10/1983 | Lu et al. | 430/106 |
| 4,935,327 | 6/1990 | Takizawa et al. | 430/110 |
| 5,294,490 | 3/1994 | Sasaki et al. | 430/110 |
| 5,449,583 | 9/1995 | Murofushi et al. | 430/137 |
| 5,516,616 | 5/1996 | Wilson et al. | 430/110 |
| 5,800,602 | 9/1998 | Baur et al. | 430/110 |

FOREIGN PATENT DOCUMENTS

| | | |
|---|---|---|
| 0561687 | 9/1993 | European Pat. Off. . |
| 0720058 | 7/1996 | European Pat. Off. . |
| 0801332 | 10/1997 | European Pat. Off. . |
| 54-145542 | 11/1979 | Japan . |
| 57-139753 | 8/1982 | Japan . |
| 62-125366 | 6/1987 | Japan . |
| 63-266462 | 11/1988 | Japan . |
| 02264264 | 10/1990 | Japan . |
| 05249746 | 9/1993 | Japan . |

OTHER PUBLICATIONS

Grant, R. et al, eds. *Grant & Hackh's Chemical Dictionary*, Fifth Edition, McGraw–Hill Book Co., NY (1987), p. 478.

Diamond, A.S. ed. *Handbook of Imaging Materials*, Marcel Dekker, Inc, NY (1991), p. 163.

March, J. *Advanced Organic Chemistry: Reactions, Mechanisms, and Structure*, McGraw–Hill Book Co. NY (1968), p. 21.

Grant, R et al, ed. *Grant & Hackh's Chemical Dictionary*, Fifth Edition, McGraw–Hill Book Co., NY (1987), p. 254.

Caplus Abstract An: 1983: 622343 of JP 57139753 (Pub Aug. 1982).

*Primary Examiner*—Janis L. Dote

*Attorney, Agent, or Firm*—McDermott, Will & Emery

[57] ABSTRACT

A toner for developing electrostatic latent images in accordance with the invention features the addition of a charge control agent comprising a carboxylate compound or an ascorbate compound represented by a general formula (I) or (II).

15 Claims, 1 Drawing Sheet

TONER FOR DEVELOPING ELECTROSTATIC LATENT IMAGES

BACKGROUND OF THE INVENTION

1. Field of the Invention

The present invention generally relates to a toner for developing an electrostatic latent image formed on an image bearing body, such as a photoconductor drum, in an electrophotographic apparatus, electrostatic recording apparatus, electrostatic printing apparatus, and the like, and more particularly, to a toner featuring a charge control agent added thereto.

2. Description of the Related Art

In electrophotographic apparatuses, electrostatic recording apparatuses and electrostatic printing apparatuses and the like, various types of toners have conventionally been used for developing an electrostatic latent image formed on an image bearing body, such as a photoconductive drum and the like. It is a general practice in the art to allow such a toner to be adsorbed on an electrostatic latent image formed on the image bearing body thereby to develop the latent image into a toner image. The toner image thus formed on the image bearing body is transferred onto a copy sheet and then fixed thereon.

In order to produce a sharp image suffering no fog, a toner having a proper chargeability is required. It is further required that the toner should present little change in charge quantity over time and be insusceptible to environmental changes such as variations of humidity causing significant attenuation of the charge quantity or production of agglomeration of toner particles. For example, if the charge quantity of the toner decreases from an initial set value, an increased amount of toner particles is scattered from the developing device, thus contaminating the periphery of the developing device with toner particles or producing toner fogs all over a resultant image.

It is therefore a conventional practice in the art to add a charge control agent to the toner material for accomplishing a stabile chargeability thereof.

Recently, a demand exists for a charge control agent of a white or pale color having an excellent color reproducibility such as to meet the need of production of color images.

Unfortunately, most of the charge control agents, which are colorless, white or pale yellow in color and generally used for imparting negative charges to the toner particles, comprise compounds containing heavy metals, such as a complex or a salt of chromium. The heavy metals are not desirable in a safety standpoint. Hence, demand exists for a negative charge control agent free from a heavy metal.

SUMMARY OF THE INVENTION

It is an object of the invention to provide a toner for developing electrostatic latent images which employs a negative-charge control agent free from a heavy metal.

It is another object of the invention to provide a toner for developing electrostatic latent images which features quick start of charging, stable chargeability, spent-resistance and insusceptibility to environmental changes.

It is still another object of the invention to provide a toner for developing electrostatic latent images which presents excellent color reproducibility and light-transmitting property.

In accordance with a first aspect of the invention, a toner material for developing electrostatic latent images incorporates therein a charge control agent comprising a carboxylate compound represented by the following general formula (I):

(I)

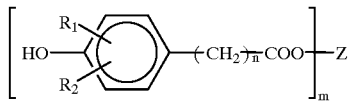

wherein $R_1$ and $R_2$ each indicate any one of a hydrogen atom, an electron attractive substituent, an alkyl group, an alkoxy group and a hydroxyl group; Z indicates any one of an alkyl group, an alkylene group, an aralkyl group, aralkylene group, an aryl group, an arylene group and a heterocyclic group, which groups may have a substitutent, respectively; n indicates an integer of 0 to 2, and m indicates an integer of 1 to 4.

In accordance with a second aspect of the invention, a toner incorporates an ascorbate compound represented by the following general formula (II):

(II)

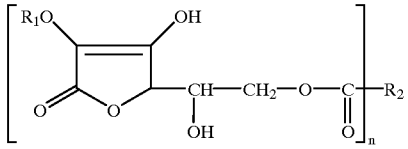

wherein $R_1$ indicates a hydrogen atom or —$COR_3$ group, $R_3$ of which indicates any one of an alkyl group, an aralkyl group and an aryl group which may have a substituent, respectively; $R_2$ indicates any one of an alkyl group, an aralkyl group, an aryl group, an alkylene group, an aralkylene group and an arylene group which may have a substituent, respectively; and n indicates an integer of 1 or 2.

The toner for developing electrostatic latent images according to the first or second aspect of the invention incorporating the carboxylate compound of the aforesaid general formula (I) or the ascorbate compound of the aforesaid general formula (II), as the charge control agent, accomplishes advantages such as quick start of charging, stable chargeability, spent-resistance and insusceptibility to environmental changes as well as excellent color reproducibility and light-transmitting property, without posing the problem of safety as has been experienced by the conventional toner employing the charge control agent containing a heavy metal.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
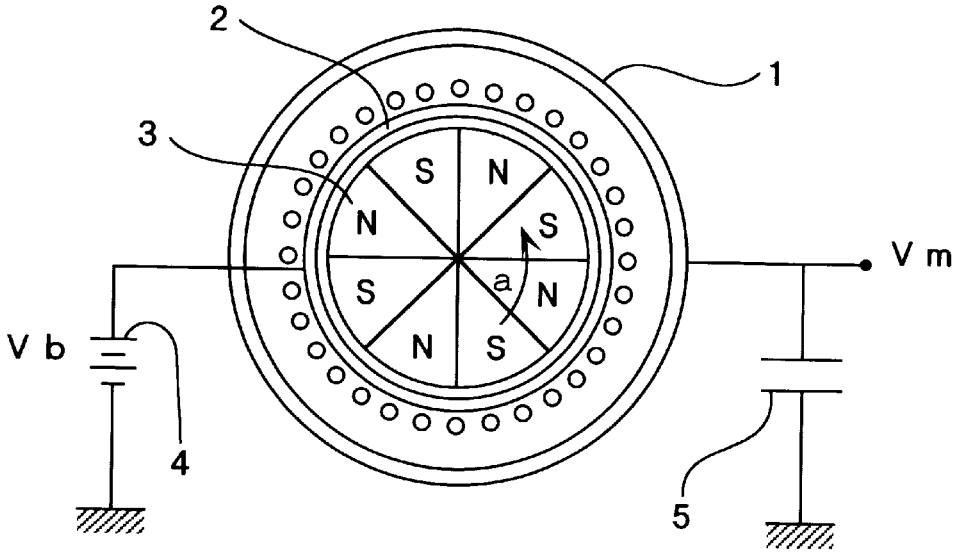
FIG. 1 is a schematic diagram illustrating a device used for measuring charge quantities of toners and amounts of toners of low charge.

Preferred embodiments of the invention will hereinbelow be described in detail.

First, description will be given on a toner for developing electrostatic latent images in accordance with a first embodiment of the invention.

The toner for developing electrostatic latent images according to the first embodiment of the invention incorporates a charge control agent comprising a carboxylate compound of the aforementioned general formula (I). The carboxylate compound is used particularly as a negative-charge control agent for negatively charging a toner material.

As to the carboxylate compound of the aforementioned general formula (I), preferred examples of $R_1$ and $R_2$ of the aforementioned formula include a hydrogen atom, an alkyl group having 1 to 6 carbons, an alkoxy group having 1 to 6 carbons, electron attractive-substituents such as a halogen atom, a halogenated alkyl group, a halogenated alkoxy group, a nitro group and a cyano group, a hydroxyl group and the like.

Preferred examples of Z of the aforementioned formula include aralkyl groups such as an alkyl group having 1 to 6 carbons, a benzyl group and a phenethyl group, aryl groups such as a phenyl group and a naphthyl group, and heterocyclic groups such as a pyridyl group, a furyl group and a thiophene group. In case where the aforesaid "m" is not smaller than 2, examples of a suitable "Z" include an alkylene group, an arlkylene. group, an arylene group and a divalent heterocyclic group. Incidentally, the "Z" may have a substituent such as a halogen atom, an alkyl group, an alkoxy group, a hydroxy group and the like.

Examples of the carboxylate compound represented by the aforesaid formula (I) include those represented by the following general formulas (1) to (65).

(1)

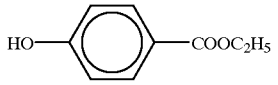

(2)

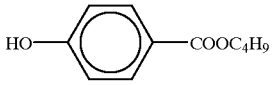

(3)

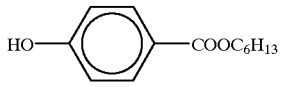

(4)

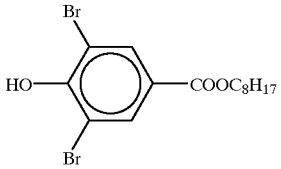

(5)

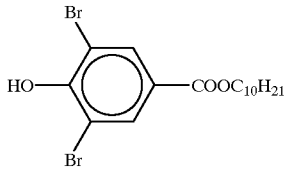

(6)

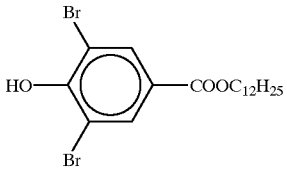

(7)

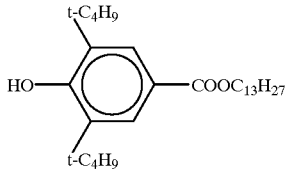

(8)

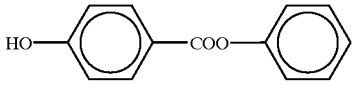

(9)

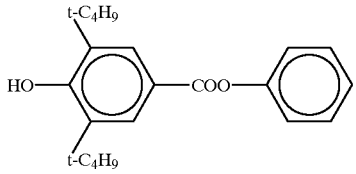

(10)

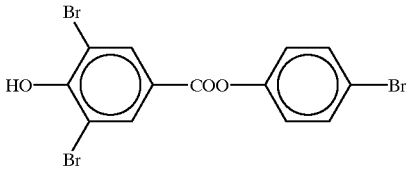

(11)

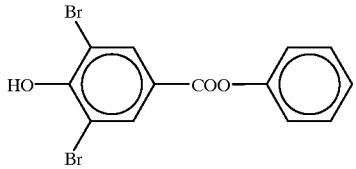

(12)

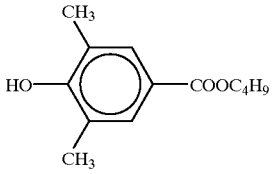

-continued
(13)
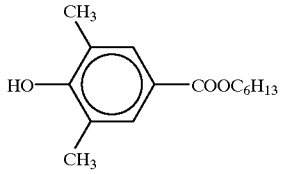
(14)
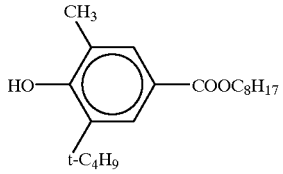
(15)
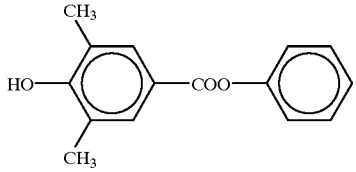
(16)
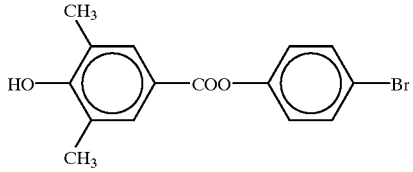
(17)
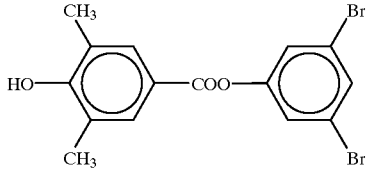
(18)
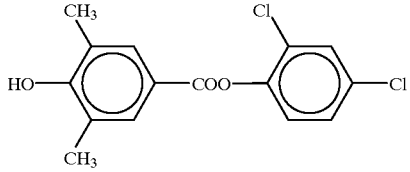
(19)
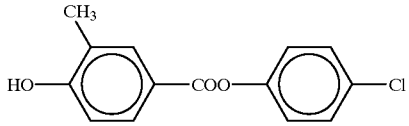
(20)
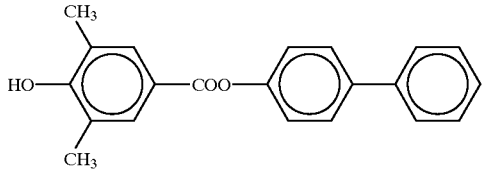
(21)
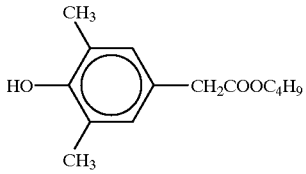
(22)
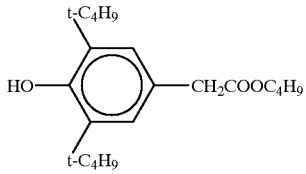
(23)
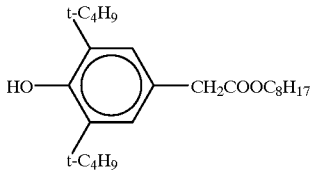
(24)
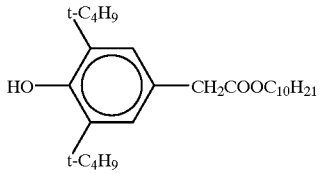
(25)
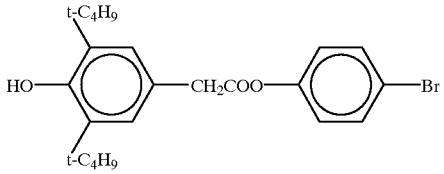
(26)
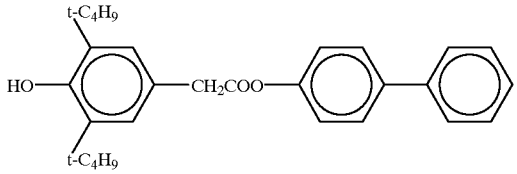
(27)
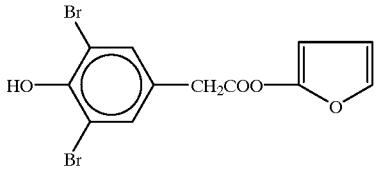
(28)
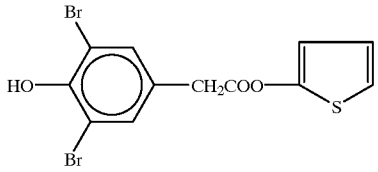

-continued
(29)
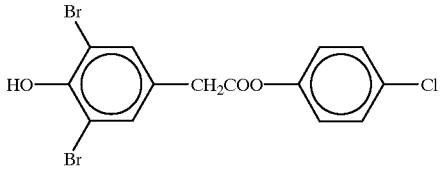
(30)
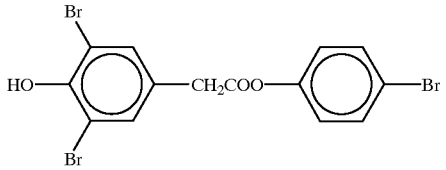
(31)
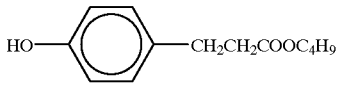
(32)
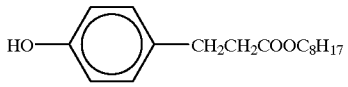
(33)
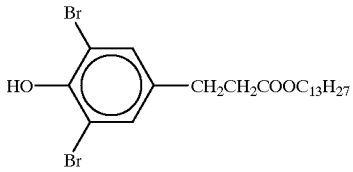
(34)
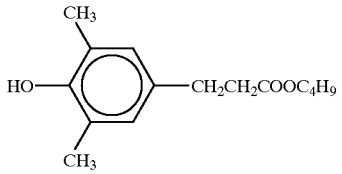
(35)
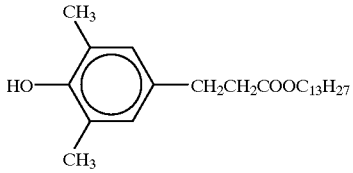
(36)
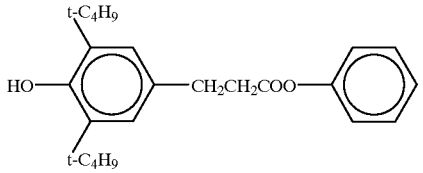
(37)
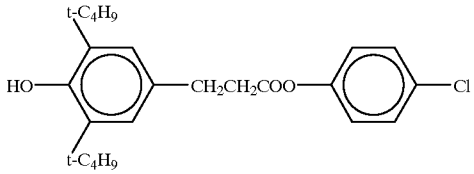
(38)
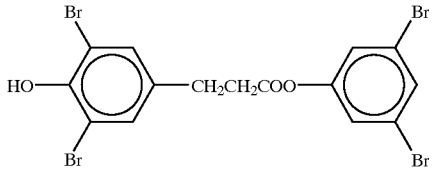
(39)
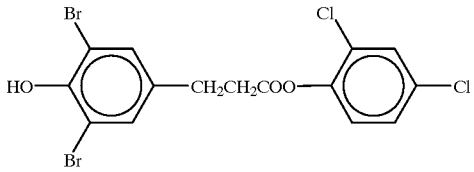
(40)
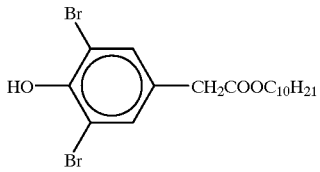
(41)
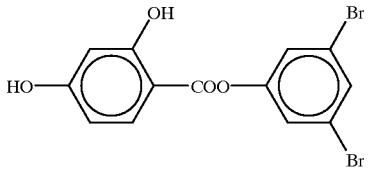
(42)
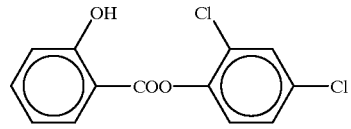
(43)
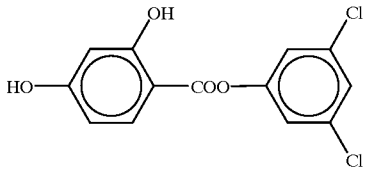
(44)
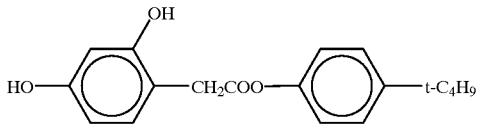

-continued
(45)
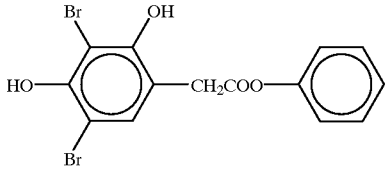
(46)
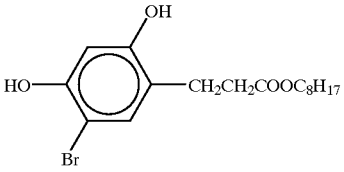
(47)
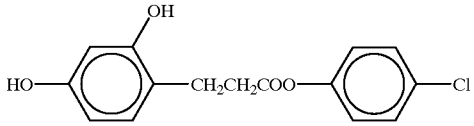
(48)
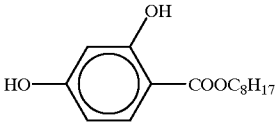
(49)
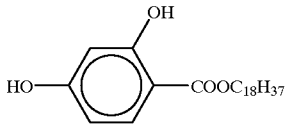
(50)
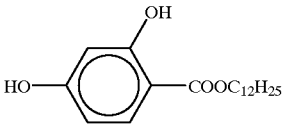
(51)
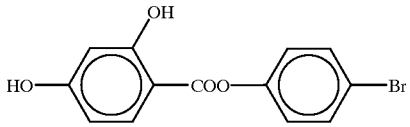
(52)
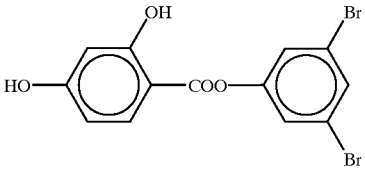
(53)
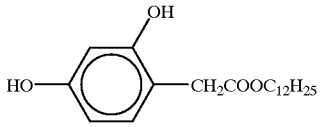
(54)
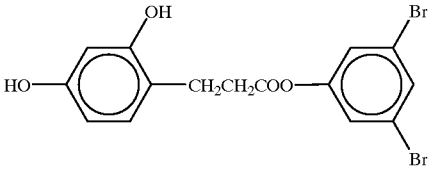
(55)
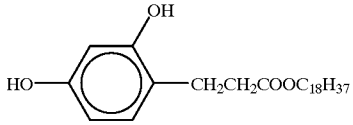
(56)
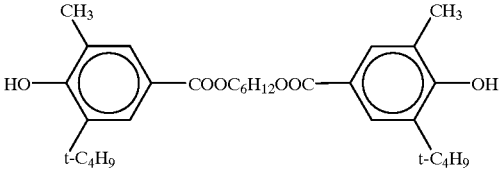
(57)
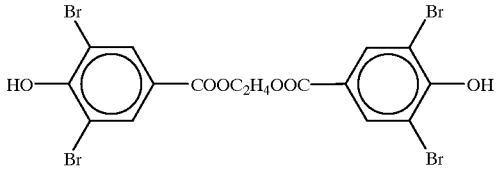
(58)
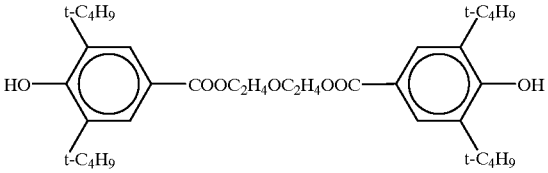
(59)
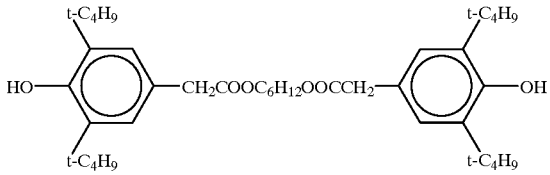
(60)
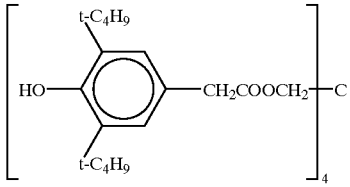

-continued (61)

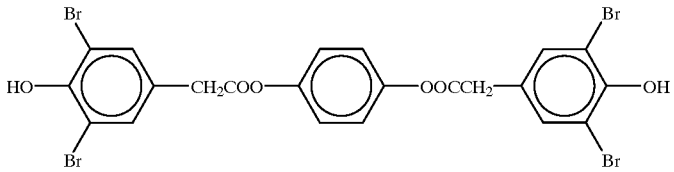

(62)

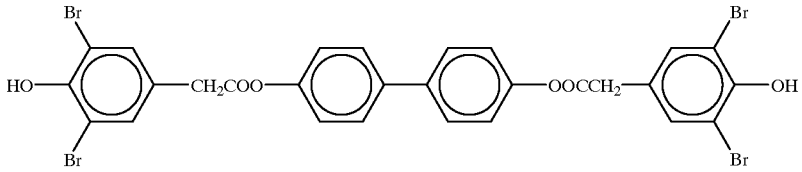

(63)

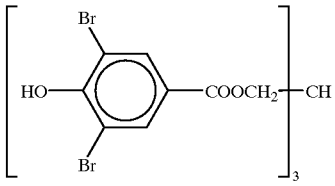

(64)

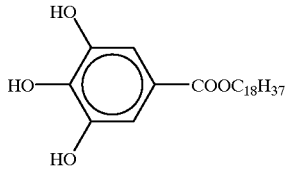

(65)

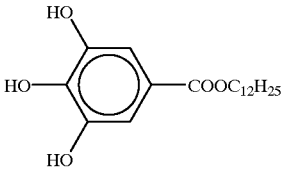

In the toner for developing electrostatic latent images according to the first embodiment of the invention, the aforesaid carboxylate compound as the charge control agent may be used alone or in combination with other charge control agent. Examples of other charge control agent usable in combination with the carobxylate compound include a metal salicylate complex, a metal benzilate complex and the like.

The aforesaid carboxylate compound may be synthesized at a high yield by steps of, for example, halogenating or nitrating a corresponding carboxylate compound as a material, or by obtaining a carboxylate or a halogenated carboxylate from a phenol compound with a substituent corresponding to the material, followed by bringing the resultant product into reaction with a corresponding alcohol compound.

Next, description will be given on the toner for developing electrostatic latent images in accordance with the second embodiment of the invention.

The toner for developing electrostatic latent images according to the second embodiment of the invention incorporates a charge control agent comprising an ascorbate compound of the aforementioned general formula (II). The ascorbate compound is used particularly as a negative-charge control agent for negatively charging the toner material.

In case where an ascorbate compound of the general formula (II) comprises a long-chain alkyl group as $R_1$ and $R_2$ thereof, the compound contributes to an improved chargeability and stable charge of the resultant toner.

Examples of the ascorbate compound of the aforementioned general formula (II) include those represented by the following chemical formulas (66) to (101).

(66)

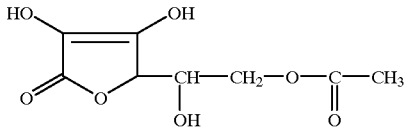

(67)

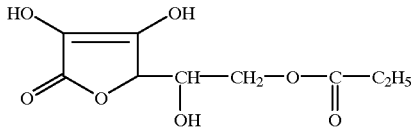

(68)

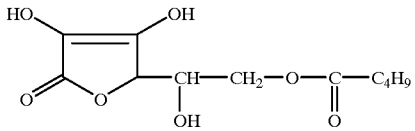

(69)

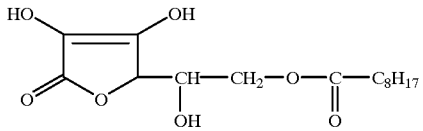

-continued
(70)
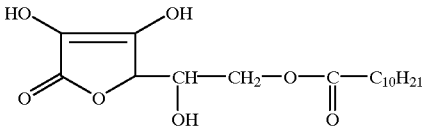
(71)
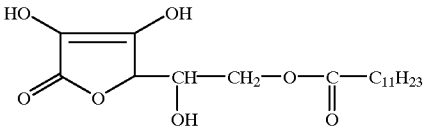
(72)
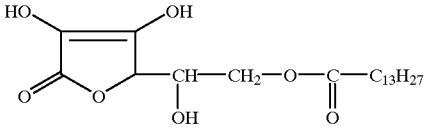
(73)
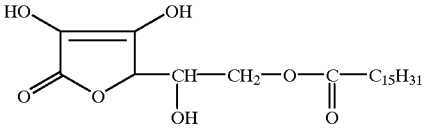
(74)
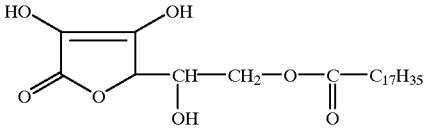
(75)
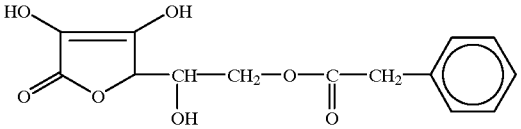
(76)
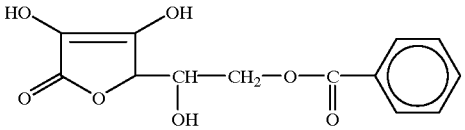
(77)
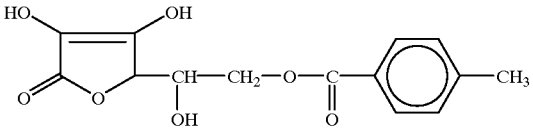
(78)
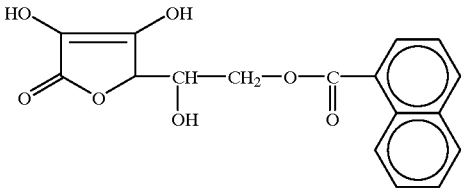
(79)
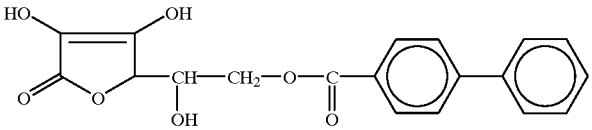
(80)
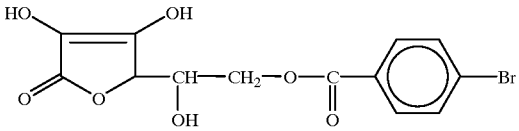
(81)
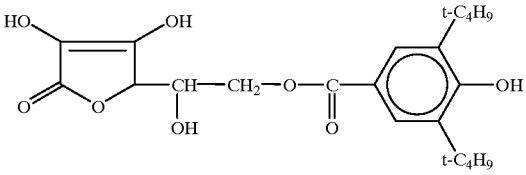
(82)
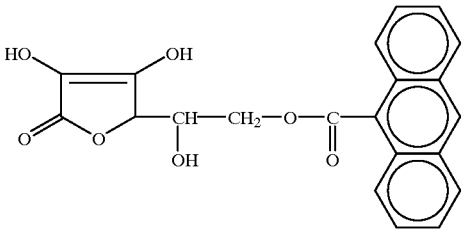
(83)
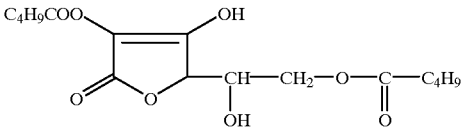
(84)
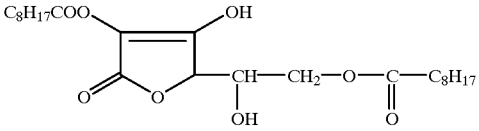
(85)
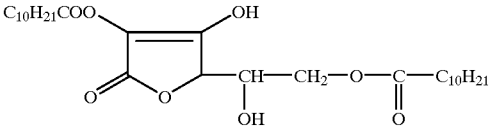
(86)
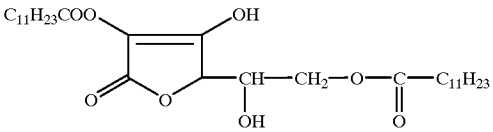
(87)
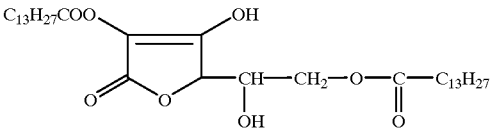

-continued
(88)
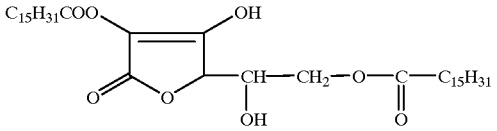
(89)
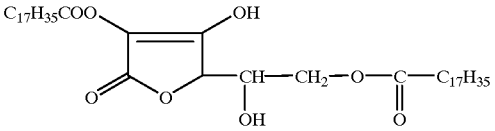
(90)
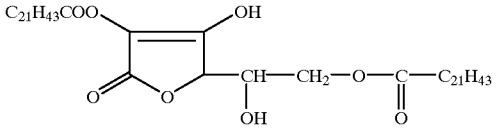
(91)
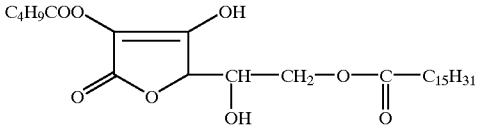
(92)
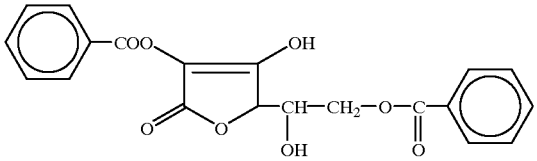
(93)
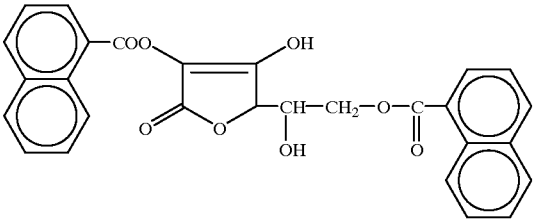
(94)
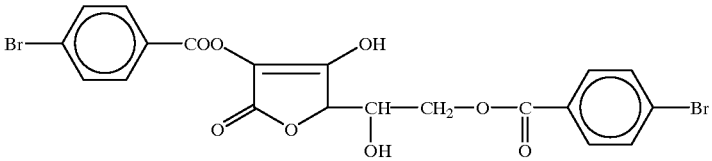
(95)
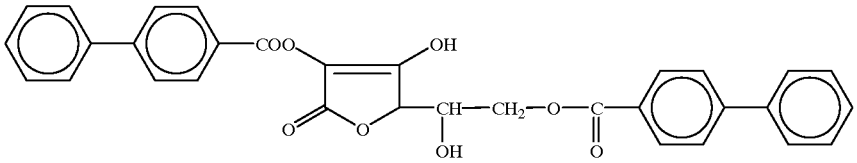
(96)
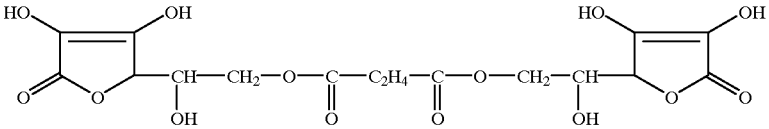
(97)
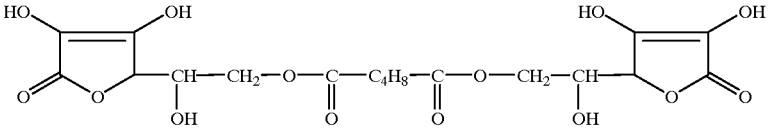
(98)
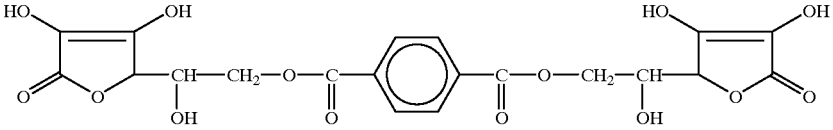
(99)
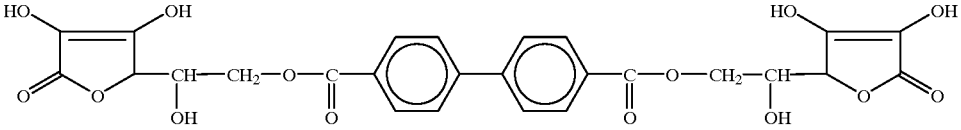

-continued (100)

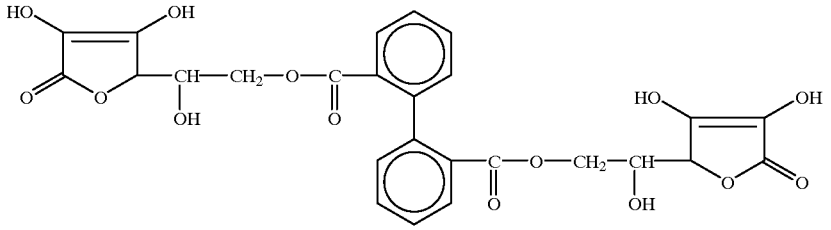

(101)

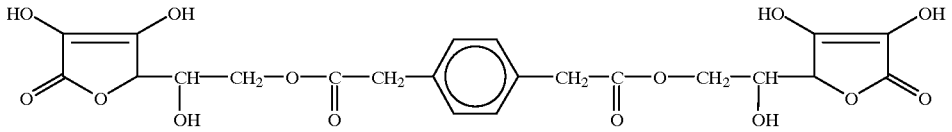

In the toner for developing electrostatic latent images according to the second embodiment of the invention, the aforesaid ascorbate compound as the charge control agent may be used alone or in combination with other charge control agent. Examples of other charge control agent usable in combination with the ascorbate compound include a metal salcylate complex, a metal benzilate complex and the like.

The ascorbate compound may be synthesized particularly at a high yield from, for example, a corresponding ascorbic acid and acid chloride, as materials, by the use of a basic catalyst such as pyridine or the like.

In accordance with the first and second embodiments of the invention, the toner for developing electrostatic latent images use the carboxylate compound of the general formula (I) or the ascorbate compound of the general formula (II) as the charge control agent and may comprise toner materials prepared by the process known to the art to be blended with such a charge control agent.

Examples of the toner employed by the invention include a toner prepared by the pulverization process wherein a binder resin, a colorant and other ingredients, as required, are melted by heating, cooled and then pulverized and classified; a toner prepared by the suspension polymerization process wherein at least more than one types of monomers and a polymerization initiator sparingly soluble to water and soluble to the monomer are dispersed in water for polymerization; an encapsulated toner configured such that a core material comprising a fixing resin and a colorant is coated with a shell layer; a toner prepared by the suspension granulation process wherein a resin solution comprising an organic solvent and a binder resin dissolved therein is dispersed in a dispersion medium for granulation; a toner prepared by the non-aqueous dispersion polymerization process wherein, in a dispersion solvent medium comprising an organic solvent or a mixture of an organic solvent and water, and an organic solvent, at least more than one types of monomers and a polymerization initiator sparingly soluble to the medium and soluble to the monomer is dispersed for polymerization; a toner comprising a matrix of a thermoplastic resin and a disperse phase of a thermoplastic resin dispersed in the matrix resin as isolated therefrom, and having substantially the total amount of colorant injected in the disperse phase of the resin; a toner obtained by the steps of heating particles comprising at least a resin and a colorant and prepared by suspension polymerization so as to produce the aggregate thereof, and of grinding the resultant aggregate; a toner particle prepared by suspension-polymerization comprising a graft polymer containing carbon black; a toner obtained by spray drying; a spherical toner obtained by heat-treating a toner prepared by the pulverization process; a toner comprising a mixture of the spherical toner particles and toner particles in determinate forms.

The aforesaid charge control agent comprised of the carboxylate compound or ascorbate compound may be added to the aforementioned toner materials in a manner to be incorporated in the toner particles or to be fixed on the particle surface of the toner.

In case where the aforesaid charge control agent is incorporated in the toner particles, a toner may be prepared by any of the aforementioned processes after addition of the charge control agent depending upon a resin component of the toner material and additives such as a colorant. In the case of the encapsulated toner, the toner is preferably prepared such that the charge control agent is contained in the shell layer.

In case where the aforesaid charge control agent is fixed on the particle surface of the toner, the charge control agent may be adhered to the particle surface of toner by means of the action of Van der Waals force, electrostatic force or the like and then fixed thereon by means of mechanical shock or the like. The fixing treatment can be made by either the wet process or the dry process.

Examples of the dry process machines preferably employed for fixing the charge control agent on the particle surface of the toner include Hybridization System commercially available from Nara Machines Co., Ltd., Ang-Mill commercially available from Hosokawa Micron Corporation, Mechano Mill commercially available from Okada Co., Ltd. and the like, the machines utilizing the air jet impact process. However, usable machines should not be limited to these and many other various devices can be employed.

A mixing ratio of the charge control agent such as of the carboxylate compound of the formula (I) or the ascorbate compound of the formula (II), is suitably decided depending upon an amount of other additives to be added to the toner, a type of resin to be used for the toner, and a system to which the toner is to be applied, that is, whether the toner is applied to the one component development system utilizing the toner alone or to the two components development system utilizing the toner and a carrier in combination.

Where toner particles produced by the pulverization process or suspension process contain the charge control agent therein, a mixing ratio of the aforesaid charge control agent on the basis of 100 parts by weight of a resin used for the toner is in the range of between 0.1 and 20 parts by weight, preferably between 1 and 10 parts by weight and more preferably between 1 and 5 parts by weight. More specifically, if less than 0.1 part by weight of charge control agent is incorporated in the toner particles, the resultant toner may not be fully charged. If, on the other hand, more than 20 parts by weight of charge control agent is incorporated therein, the resultant toner may suffer unstable charge quantity or reduced fixing property.

Where the aforesaid charge control agent is adhered to and fixed on the particle surface of the toner, a mixing ratio of the charge control agent on a basis of 100 parts by weight of toner particles is in the range of between 0.001 and 10 parts by weight, preferably between 0.05 and 2 parts by weight, or more preferably between 0.1 and 1 part by weight. More specifically, if less than 0.001 part by weight of the charge control agent is adhered to and fixed on the particle surface of the toner, the resultant toner may not be fully charged because of an insufficient amount of the charge control agent present on the particle surface of the toner. If, on the other hand, the charge control agent exceeds 10 parts by weight, the charge control agent fails to be securely fixed on the particle surface of the toner, resulting in separation thereof from the particle surface of the toner during use.

If the charge control agent is fixed on the particle surface of the toner in this manner, even a small amount of charge control agent allows the toner to be sufficiently charged. Additionally, the carbaxylate compound and the ascorbate compound are white in color, thus imparting the resultant toner with a good chargeability or providing a color toner suitable for forming sharp color images.

Where the charge control agent of the carboxylate compound or the ascorbate compound is incorporated into the toner particles, preferably used is a charge control agent having a particle size of not greater than 5 $\mu$m, preferably not greater than 3 $\mu$m, or more preferably not greater than 1 $\mu$m. If a charge control agent has a size greater than 5 $\mu$m, the charge control agent is nonuniformly dispersed in the toner particles and nonuniform chargeability of the toner results.

Where the charge control agent of the carboxylate compound or the ascorbate compound is adhered to particle surface of the toner, preferably used is a charge control agent having a particle size of not greater than 1 $\mu$m or more preferably not greater than 0.5 $\mu$m. More specifically, if a charge control agent has a size greater than 1 $\mu$m, it is difficult to uniformly adhere the charge control agent to the particle surface of the toner.

It is to be noted that the charge control agent of the carboxylate compound or the ascorbate compound may be used in combination with other negative-charge control agent. Further, a minute amount of positive charge control agent may be added for stable chargeability of the toner. Incidentally, in case where the charge control agent of the carboxylate compound or the ascorbate compound is used in combination with other charge control agent, the total amount of used charge control agents should preferably be within the aforementioned range.

Examples of the negative-charge control agent usable in combination with the charge control agent of a carboxylate compound or an ascorbate compound include OIL BLACK (Color Index 26150), OIL BLACK-BY (commercially available from Orient Chemical Co., Ltd.), metal salycilate complex E-81 (commercially available from Orient Chemical Co., Ltd.), thioindigo pigments, a sulfonylamine derivative of copper phthalocyanine, SPIRON BLACK-TRH (commercially available from Hodogaya Chemical), BONTRON S-34 (commercially available from Orient Chemical Co., Ltd.), Nigrosine SO (commercially available from Orient Chemical Co., Ltd.), CERESSCHWARZ(R)G (commercially available from Farben Fabricken Bayer), CHROMOGENSCHWARZ ETOO (C.I.No.14645), AZOOIL BLACK(R) (commercially available from National Aniline), borons, calcium compounds and the like.

Examples of the positive-charge control agent usable in combination with the charge control agent of a carboxylate compound or an ascorbate compound include NIGROSINE BASE EX (commercially available from Orient Chemical Co., Ltd.), quaternary Ammonium salt P-51 (commercially available from Orient Chemical Co., Ltd.), Nigrosine, BONTRON N-01 (commercially available from Orient Chemical Co., Ltd.), SUDANCHIEFSCHWARZ BB (Solvent Black 3; Color Index 26150), FETTESCHWARZ HBN (C.I.No.26150), BRILLIANT SPIRITZSCHWARZ TN (commercially available from Farben Fabricken Bayer), SABONSCHWARZ X (Ferberque Hoechst), alkoxylated amine, alkylamide, molybdate chelate pigments, imidazole compounds and the like.

Incidentally; a minute amount of the charge control agent of the aforesaid carboxylate compound or ascorbate compound may be added to a positive-charge toner utilizing the aforementioned positive-charge control agent for stabilization of the chargeability thereof.

Various types of binder resins generally used for typical toner materials may be used as a resin component of the toner of the invention. Examples of the usable binder resin include thermoplastic resins such as styrene resins, (meth) acrylic resins, olefin resins, amide resins, carbonate resins, polyether, polysulfone, polyester resin, epoxy resin and the like; thermosetting resins such as urea resin, urethane resin, epoxy resin and the like; and copolymers and polymer blends of the above, but are not particularly limited to these. It is to be noted that resins usable for the toners for developing electrostatic latent images according to the invention are not limited to, for example, those in a perfect polymer state like the thermoplastic resins and may further include resins in an oligomer or a prepolymer state like the thermosetting resins, and polymers partially containing a prepolymer or a crosslinking agent.

Examples of monomers composing the aforesaid binder resins include various types of monomers as below.

Examples of vinyl monomers include styrenes such as styrene, o-methyl styrene, m-methyl styrene, p-methyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-phenyl styrene, p-chlorstyrene, 3,4-dichlorstyrene and the derivatives thereof. Above all, styrene is most preferred. Examples of other vinyl monomers include unsaturated monoolefins of ethylene such as ethylene, propylene, butylene, isobutylene and the like; halogenated vinyls such as vinyl chloride, vinylidene chloride, vinyl bromide, vinyl fluoride and the like; vinyl esters such as vinyl acetate, vinyl propionate, vinyl benzoate, vinyl butyrate and the like; $\alpha$-methylene aliphatic acid monocarboxylates such as methyl acrylate, ethyl acrylate, n-butyl acrylate, isobutyl acrylate, propyl acrylate, n-octyl acrylate, dodecyl acrylate, 2-ethyl hexyl acrylate, stearyl acrylate, 2-chloroethyl acrylate, phenyl acrylate, $\alpha$-methyl chloracrylate, methyl methacrylate, ethyl methacrylate, propyl methacrylate, n-butyl methacrylate, isobutyl methacrylate, propyl methacrylate, n-octyl methacrylate, dodecyl methacrylate, 2-ethyl hexyl methacrylate, stearyl methacrylate, phenyl methacrylate, dimethylaminoethyl methacrylate, diethylaminoethyl methacrylate and the like; derivatives of (meta)acrylates such as acrylonitrile, methacrylonitrile, acrylamide and the like; vinyl ethers such as vinyl methylether, vinyl ethylether, vinyl isobutyl ether and the like; vinyl ketones such as vinyl methyl ketone, vinyl hexyl ketone, methyl isopropenyl ketone and the like; N-vinyl compounds such as N-vinyl pyrrole, N-vinyl carbazole, N-vinyl indole, N-vinyl pyrolidone and the like; and vinyl naphthalins.

Examples of monomers used to obtain an amide resin include caprolactam; dibasic acids such as terephthalic acid, isophthalic acid, adipic acid, maleic acid, succinic acid, cebacic acid, thioglycolic acid and the like; and diamines such as ethylenediamine, diaminoethyl ether, 1,4-diaminobenzene, 1,4-diaminobutane and the like.

Examples of monomers used to obtain a urethane resin include di-isocyanates such as p-phenylene diisocyanate, p-xylene diisocyanate, 1,4-tetramethylene diisocyanate; and glycols such as ethylene glycol, diethylene glycol, propylene glycol, polyethylene glycol and the like.

Examples of monomers used to obtain a urea resin include diisocyanates such as p-phenylene diisocyanate, p-xylene diisocyanate, 1,4-tetramethylene diisocyanate and the like; and diamines such as ethylene diamine, diamino ethyl ether, 1,4-diaminobenzene, 1,4-diaminobutane and the like.

Examples of monomers used to obtain an epoxy resin include amines such as ethyl amine, butyl amine, ethylene diamine, 1,4-diaminobenzene, 1,4-diamino butane, monoethanolamine and the like; and diepoxies such as diglycidil ether, ethylene glycol diglycidilether, bisphenol A diglycidil ether, hydroquinone diglycidil ether and the like.

Examples of monomers used to obtain a polyester resin include polyols such as ethylene glycol, diethylene glycol, triethylene glycol, 1,2-propylene glycol, 1,3-propylene glycol, 1,4-butanediol, 1,3-butanediol, 2,3-butanediol, 1,5-pentanediol, 1,6-hexanediol, neopentyl glycol, 2-ethyl-1,3-pentanediol, 2,2,4-trimethyl-1,3-pentanediol, 1,4-bis(2-hydroxymethyl)cyclohexane, 2,2-bis(4-hydroxypropoxyphenyl)propane, bisphenol A, hydrogenated bisphenol A, polyoxyethylenated bisphenol A and the like; and polybasic acids such as unsaturated carboxylates including maleic acid, fumaric acid, mesaconic acid, citraconic acid, itaconic acid, glutaconic acid, 1,2,4-benzene tricarboxylate, 1,2,5-benzene tricarboxylate and the like, saturated carboxylates including phthalic acid, terephthalic acid, isophthalic acid, succinic acid, adipic acid, malonic acid, cebacic acid, 1,2,4-cyclohexanetricarboxylate, 1,2,5-cyclohexanetricarboxylate, 1,2,4-butanetricarboxylate, 1,3-dicarboxy-2-methyl-2-methylcarboxypropane, tetra(methylcarboxy)methane and the like, or anhydrides thereof and esters thereof with lower alcohol. Examples of such anhydrides or esters include maleic anhydride, phthalic anhydride, tetrahydrophthalic anhydride, hexahydrophthalic anhydride, endomethylene tetrahydrophthalic anhydride, tetrachlorophthalic anhydride, tetrabromophthalic anhydride, dimethyl terephthalate and the like.

It is to be noted that the polyester resins employed by the invention are not limited to those obtained by polymerizing a combination of one type of polyol and one type of polybasic acid, as described above, but may further include those obtained by polymerizing a combination of plural types of the respective components. Examples of polybasic acids particularly used in combination include that of an unsaturated carboxylate and a saturated carboxylate and of a polycarboxylate and a polycarboxylate anhydride.

Where the aforementioned thermoplastic resin material is used as a resin component of the toner, any of low-molecular-weight polyolefin waxes is preferably added to the thermoplastic resin material. A mixing ratio of the low-molecular-weight polyolefin wax on a basis of 100 parts by weight of the thermoplastic resin material is in the range of 1 to 10 parts by weight, and preferably of 2 to 6 parts by weight. More specifically, if such an amount of low-molecular-weight polyolefin wax is added to the thermoplastic resin material, the aforesaid charge control agent of the carboxylate compound or the ascorbate compound can perform a preferable negative charge control on the resultant resin material, thereby imparting a proper chargeability thereto.

As a resin component of the toner, polyester resins receive attention because of its resistance to adhesion to vinyl chloride, light-transmitting property as rendered into a transparent color toner, and an adhesive property to OHP sheet. Where the polyester resin is used for a transparent toner, preferably employed is a linear polyester having a glass transition temperature of between 55 and 70° C. and a softening point of between 80 and 150° C. Where the polyester resin is used for a toner adapted for oilless fixing, preferably employed is a polyester resin having a glass transition temperature of between 55 and 80° C. and a softening point of between 80 and 150° C., and containing 5 to 20 wt % of a gelling component.

In preparation of a toner adapted for low-temperature fixing, preferably employed is a polyester resin having an onset run-off temperature of 100° C. or less as measured by a flow tester and a softening point of 110° C. or less.

The aforementioned charge control agent of the carboxylate compound or ascorbate compound is applicable to a toner comprising a vinyl-modified polyester resin obtained by graft polymerizing and/or block polymerizing a vinyl monomer comprising a vinyl monomer and an amino-group-containing vinyl monomer with an unsaturated polyester component comprising at least an aliphatic unsaturated dibasic acid and a polyalcohol.

A variety of types and colors of organic and inorganic pigments and dyes conventionally used in the art are usable as a colorant contained in the toner of the invention.

Examples of usable black pigments include carbon black, cupric oxide, manganese dioxide, aniline black, activated carbon and the like.

Examples of usable yellow pigments include chrome yellow, zinc yellow, cadmium yellow, yellow oxide, mineral fast yellow, nickel titanium yellow, NABLES YELLOW, NAPHTHOL YELLOW S, HANSA YELLOW G, HANSA YELLOW 10G, benzidine yellow G, benzidine yellow GR, quinoline yellow lake, permanent yellow NCG, tartrazine lake and the like.

Examples of usable orange pigments include chrome orange, molybdenum orange, permanent orange GTR, pyrazolone orange, VULCAN ORANGE, INDANTHRENE BRILLIANT ORANGE RK, benzidine orange G, INDANTHRENE BRILLIANT ORANGE GK and the like.

Examples of usable red pigments include iron oxide red, cadmium red, red lead oxide, cadmium mercury sulfide, cadmium, permanent red 4R, LITHOL RED, pyrazolone red, WATCHING RED, calcium salt, lake red D, BRILLIANT CARMINE 6B, eosin lake, rhodamine lake B, alizarin lake, BRILLIANT CARMINE 3B and the like.

Examples of usable violet pigments include manganese violet, fast violet B, methyl violet lake and the like.

Examples of usable blue pigments include prussian blue, cobalt blue, alkali blue lake, victoria blue lake, phthalocyanine blue, metal-free phthalocyanine blue, phthalocyanine blue partial chlorine compound, FAST SKY BLUE, INDANTHRENE BLUE BC and the like.

Examples of usable green pigments include chrome green, chrome oxide, pigment green B, malachite green lake, FANAL YELLOW GREEN G and the like.

Examples of usable white pigments include zinc white, titanium oxide, antimony white, zinc sulfide and the like.

Examples of usable extender pigments include powdery barytes, barium carbonate, clay, silica, white carbon, talc, alumina white and the like.

As various types of dyes such as basic dyes, acid dyes, disperse dyes and direct dyes, usable are nigrosine, methylene blue, rose bengale, quinoline yellow, ultramarine blue and the like.

These colorants may be used alone or in combination of plural types. The content of colorants in total is 1 to 20 parts by weight and more preferably, 2 to 10 parts by weight per 100 parts by weight of the resin component of the toner. More specifically, if the total content of colorant exceeds 20 parts by weight, the toner is reduced in the fixing properties thereof, whereas if the total content of the colorants is smaller than 1 part by weight, a desired image density may not be obtained.

Various types and colors of pigments and dyes, as listed below, are usable as the colorant of a transparent color toner.

Examples of usable yellow pigments include C.I.10316 (naphthol yellow S), C.I.11710 (HANSA YELLOW 10G), C.I.11660 (HANSA YELLOW 5G), C.I.11670 (HANSA YELLOW 3G), C.I.11680 (HANSA YELLOW G), C.I.11730 (HANSA YELLOW GR), C.I.11735 (HANSA YELLOW A), C.I.11740 (HANSA YELLOW RN), C.I.12710 (HANSA YELLOW R), C.I.12720 (PIGMENT YELLOW L), C.I.21090 (benzidine yellow), C.I.21095 (benzidine yellow G), C.I.21100 (benzidine yellow GR), C.I.20040 (permanent yellow NCG), C.I.21220 (VULCAN FAST YELLOW 5), C.I.21135 (VULCAN FAST YELLOW R) and the like.

Examples of usable red pigments include C.I.12055 (STERLING I), C.I.12075 (permanent orange), C.I.12175 (LITHOL FAST ORANGE 3GL), C.I.12305 (permanent orange GTR), C.I.11725 (HANSA YELLOW 3R), C.I.21165 (VULCAN FAST ORANGE GG), C.I.21110 (benzidine orange G), C.I.12120 (permanent red 4R), C.I.1270 (PARA RED), C.I.12085 (FIRE RED), C.I.12315 (BRILLIANT FAST SCARLET), C.I.12310 (permanent red FR2), C.I.12335 (permanent red F4R), C.I.12440 (permanent red FRL), C.I.12460 (permanent red FRLL), C.I.12420 (permanent red F4RH), C.I.12450 (LIGHT FAST RED TONER B), C.I.12490 (permanent carmine FB), C.I.15850 (BRILLIANT CARMINE 6B) and the like.

Examples of usable blue pigments include C.I.74100 (metal-free phthalocyanine blue), C.I.74160 (phthalocyanine blue), C.I.74180 (FAST SKY BLUE) and the like.

These colorants for the transparent color toner may be used alone or in combination of plural types. The content of colorants in total is in the range of 1 to 10 parts by weight and more preferably of 2 to 5 parts by weight per 100 parts by weight of the resin component of the toner. More specifically, if the total content of the colorants exceeds 10 parts by weight, the toner is reduced in the fixing and light-transmitting properties thereof, whereas if the content of the colorants is smaller than 1 part by weight, a desired image density may not be obtained.

In case where carbon black is used as the colorant, preferred is a carbon black having a pH not greater than 7. More specifically, the carbon black with a pH not greater than 7 is favorably dispersed in the binder resin by virtue of a polar group present on the surface thereof. When used for small toner particles having an average particle size of 2 to 9 $\mu$m, in particular, such a carbon black is properly dispersed in the binder resin. Additionally, the carbon black is effective in improving negative chargeability of the negative-charge toner.

Incidentally, an anti-offset agent may be added to the toner of the invention for improving the fixing property thereof.

Examples of suitable anti-offset agents include various types of waxes and particularly preferred are polyolefin waxes such as a low-molecular-weight polypropylene, polyethylene, or oxidized polypropylene and polyethylene; and natural waxes such as carnauba wax, rice wax, and montan waxes. A mixing ratio of such an anti-offset agent is in the range of 1 to 10 parts by weight or more preferably of 2 to 6 parts by weight per 100 parts by weight of the binder resin contained in the toner. A wax suitably used as the anti-offset agent preferably has a number average molecular weight Mn of between 1000 and 20000 and a softening point Tm of between 80 and 100° C. If a wax having a number average molecular weight Mn smaller than 1000 or a softening point Tm lower than 80° C. is used, the wax is not uniformly dispersed in the resin of the toner and eluted on the toner surface. This leads to a lowered keeping quality and developing performance of the resultant toner, or film forming on the photoconductive drum. On the other hand, if a wax having a number average molecular weight Mn greater than 20000 or a softening point Tm over 150° C. is used, the compatibility of the wax with the toner may be lowered so that effects such as offset resistance at high temperatures cannot be obtained. Incidentally, it is desirable to use a wax having a polar group in case where the toner employs a resin having a polar group in the light of the compatibility of the wax with the toner.

For enhancement of fluidity of the toner of the invention, a fluidizing agent may be added to the toner.

Examples of the usable fluidizing agent include various types of metal oxides such as silica, aluminum oxide, titanium oxide, a mixture of silica and aluminum oxide, and a mixture of silica and titanium oxide; magnesium fluoride and the like. These fluidizing agents may be adhered to the toner surface or incorporated in the toner particles.

The toner of the invention may further contain a cleaning assistant for improvement in the cleaning property thereof so that the toner may adequately be removed from the photoconductive drum or the like.

Examples of the usable cleaning assistant include the aforesaid inorganic particulates used as the fluidizing agent, a metal soap such as of stearate, particulates of various synthetic resins such as of fluorines, silicones, styrene-(meta)acrylics, benzoguanamine, melamine, epoxy and the like. Usable as the aforesaid synthetic particulates are a variety of organic particulates of styrenes, (meta)acrylics, olefins, fluorine-containing resins, nitrogen-containing (meta)acrylics, silicone, benzoguanamine, melamine and the like, which are granulated by means of wet polymerization processes such as emulsion polymerization, soap-free emulsion polymerization, non-aqueous dispersion polymerization and the like or gas phase polymerization process. The synthetic particulates are substantially in spherical shape having an average particle size of 0.01 to 3 $\mu$m and more preferably of 0.05 to 2 μm, the average size thereof being smaller than the average particle size of the toner. A mixing ratio of such synthetic particulates is in the range of between 0.01 and 10 wt %, preferably of between 0.1 and 5 wt % and more preferably of between 0.1 and 2 wt % on the basis of the amount of toner.

The toner of the invention may be a magnetic toner, which comprises known magnetic carrier particulates dispersed in the binder resin. Examples of the magnetic carrier particulates include known magnetic metals like ferromagnetic metals such as cobalt, iron, nickel and the like; alloys, mixtures and oxides of metals such as cobalt, iron, nickel, aluminum, lead, magnesium, zinc, antimony, beryllium, bismuth, cadmium, calcium, manganese, selenium, titanium, tungsten, vanadium and the like; and sintered iron (ferrite). A mixing ratio of such a magnetic carrier particulates is typically in the range of 1 to 80 parts by weight and more preferably of 5 to 60 parts by weight per 100 parts by weight of the binder resin in the toner.

The toner of the invention may be used alone as a one-component type developer or in combination with the carrier to form a twd-component type developer.

In the case of the two-component type developer, any of known carriers is usable, such as ferrite carrier, coating carrier, iron powder carrier, binder type carrier, carrier having complex charging surfaces.

Additionally, the toner of the invention is preferably applicable to the development system wherein the toner particles are passed through a gap between the toner regulating member comprised of a blade or roller and the toner carrier body thereby being triboelectrically charged, while a thin layer of the toner particles is formed on the surface of the toner carrier body. The above toner carrier body includes a developer roller for supplying the toner particles to the photoconductive drum and the toner supply roller for replenishing the toner particles.

The toner of the invention is also usable as a photoconductive toner.

The toner for developing electrostatic latent images according to the invention will hereinbelow be described in detail with reference to the specific examples thereof.

(EXAMPLE 1)

The following ingredients were used in the following proportion for the preparation of a toner of Example 1.

| Ingredients | Parts by weight |
|---|---|
| Styrene-n-butyl methachrylate (Softening point: 132° C., Glass transition Temp.: 60° C.) | 100 |
| Carbon black (MA#8, pH3: Mitsubishi Kagaku Corp.) | 8 |

These ingredients were sufficiently blended by a ball mill and kneaded on a triple roll mill heated to 140° C. The resultant mixture was allowed to cool to be crushed by a feather mill and subsequently pulverized by a jet mill. The resultant particles were subject to air classification to give toner particles having an average particle size of 8 μm.

As shown in the following Table 1, 1 part by weight of the carboxylate compound of the chemical formula (4), as the charge control agent, on the basis of 100 parts by weight of the above toner particles were thrown in a Henschell mixer to be blended by stirring at revs of 1500 rpm for 2 minutes thereby to make the charge control agent adhere to the surfaces of the toner particles.

The toner particles with the charge control agent adhered to the surfaces thereof were processed at revs of 6000 rpm for 3 minutes by Hybridization System (NHS-1 model commercially available from Nara Machines Co., Ltd.) thereby to fix the charge control agent onto the surfaces of the toner particles. Subsequently, added to the toner particles was 0.1 wt % of hydrophobic silica, as a post-treatment agent, having an average particle size of 17 nm (R-974 commercially available from Nippon Aerosil Co., Ltd.). The mixture was blended by a Henschell mixer (commercially available from Mitsui-Miike Kakoki K.K.) and thus was obtained the toner of Example 1.

(EXAMPLES 2 TO 4)

Toners of Examples 2 to 4 were prepared in the same manner as in Example 1 except for that the charge control agent used in Example 1 was replaced by the charge control agent of the carboxylate compound of the chemical formula (5) in Example 2, by the charge control agent of the carboxylate compound of the chemical formula (6) in Example 3 and by the charge control agent of the carboxylate compound of the chemical formula (7) in Example 4, respectively, as shown in the following Table 1.

(EXAMPLE 5)

The following ingredients were used in the following proportion for the preparation of a toner of Example 5.

| Ingredients | Parts by weight |
|---|---|
| Polyester resin (TUFFTON NE1110:Kao Soap Co., Ltd.) | 100 |
| Carbon black (MOGUL L:Cabot Inc.) | 8 |
| Charge control agent: Carboxylate compound of formula (10) | 3 |
| Carnauba wax free from liberated aliphatic acid (Melting point: 85° C., Acid value: 0.5) | 1.5 |

These ingredients were sufficiently blended by a Henschell mixer (commercially available from Mitsui-Miike Kakoki K.K.) and kneaded by a twin-screw kneader (commercially available from Ikegai K.K.). The resultant mixture was allowed to cool to be crushed by a feather mill and subsequently pulverized by a jet mill. The resultant particles were subject to air classification to give toner particles having an average particle size of 8 μm.

Subsequently, 0.2 parts by weight of hydrophobic silica, as a post-treatment agent, having an average particle size of 17 nm (H-2000 commercially available from Wacker) was added to 100 parts by weight of the toner particles. The mixture was blended by a Henschell mixer (commercially available form Mitsui-Miike Kakoki K.K.) at revs of 1000 rpm for 1 minute, and thus was obtained the toner of Example 5.

(EXAMPLES 6 TO 8)

Toners of Examples 6 to 8 were prepared in the same manner as in Example 5 except for that the charge control agent used in Example 5 was replaced by the charge control agent of the carboxylate compound of the chemical formula (14) in Example 6, by the charge control agent of the carboxylate compound of the chemical formula (17) in Example 7 and by the charge control agent of the carboxylate compound of the chemical formula (22) in Example 8, respectively, as shown in following Table 1.

(EXAMPLE 9)

The following ingredients were used in the following proportion for the preparation of a toner of Example 9.

| Ingredients | Parts by weight |
|---|---|
| Styrene-n-butyl methacrylate (Softening point: 132° C., Glass transition temp.: 60° C.) | 100 |
| Carbon black (MA#8, pH3: Mitsubishi Kagaku Corp.) | 8 |
| Low-molecular-weight polypropylene (VISCOL 550P: Sanyo Chemical Industries Ltd.) | 5 |
| Charge control agent Carboxylate compound of formula (25) | 5 |

These ingredients were sufficiently blended by a ball mill and kneaded on a triple roll mill heated to 140° C. The resultant mixture was allowed to cool and crushed by a feather mill. The resultant particles were subject to air classification to give toner particles having an average particle size of 8 μm.

To 100 parts by weight of the toner particles, there was added 0.1 part by weight of hydrophobic silica, as a post-treatment agent, having an average particle size of 17 nm (R-974 commercially available from Nippon Aerosil Co., Ltd.). The mixture was blended by a Henschell mixer (commercially available from Mitsui-Miike Kakoki K.K.) at revs of 1000 rpm for 1 minute and thus were obtained the toner particles of Example 9.

(EXAMPLE 10)

The following ingredients were used in the following proportion for the preparation of a toner of Example 10.

| Ingredients | Parts by weight |
|---|---|
| Polyester resin (TUFFTON NE382: Kao Soap Co., Ltd.) | 100 |
| BRILLIANT CARMINE 6B (C.I.15850) | 3 |
| Charge control agent Carboxylate of formula (28) | 4 |

These ingredients were sufficiently blended by a Henschell mixer (commercially available from Mitsui-Miike Kakoki K.K.) and kneaded by a twin-screw kneader (commercially available from Ikegai K.K.). The resultant mixture was allowed to cool, crushed by a feather mill and then further pulverized by a jet mill. The resultant particles were subject to air classification and thus were obtained toner particles having an average particle size of 8 μm.

To 100 parts by weight of the toner particles, there was added 0.2 parts by weight of hydrophobic silica, as a post-treatment agent, having an average particle size of 17 nm (H-2000 commercially available from Wacker). The resultant mixture was processed by a Henschell mixer (commercially available from Mitsui-Miike Kakoki K.K.) at revs of 1000 rpm for 1 minute to thereby give the toner of Example 10.

(EXAMPLE 11)

In this example, 68 parts by weight of polyoxyethylene (2)-2,2-bis(4-hydroxyphenyl)propane, 16 parts by weight of isophthalate, 16 parts by weight of terephthalate, 0.3 parts by weight of maleic anhydride, and 0.1 part by weight of dibutyltin oxide were put in a flask to be allowed to react in an atmosphere of nitrogen at 230° C. for 24 hours, thereby giving a polyester resin containing unsaturated polyester. The polyester resin had a weight average molecular weight Mw of 9800.

Subsequently, 50 parts by weight of the polyester resin was dissolved in 50 parts by weight of xylene in a flask, wherein the mixture solution of xylene was heated at reflux while a solution comprising 13 parts by weight of styrene, 2 parts by weight of methyl methacrylate and 0.6 parts by weight of azobisisobutyronitrile was added thereto dropwise for about 30 minutes in an atmosphere of nitrogen. After maintained at a constant high temperature for 3 hours, the xylene was distilled in vacuo to give styrene-acryl modified polyester resin. The styrene-acryl modified polyester resin had a weight average molecular weight Mw of 11700, a ratio of weight average molecular weight Mw to number average molecular weight Mn (Mw/Mn) of 2.8, a melt viscosity of $5\times10^4$ poise at 100° C., and a glass transition temperature of 60° C. It is to be noted that the aforesaid melt viscosity was measured by a flow tester CFT-500 commercially available from Shimadzu Corporation under conditions of a nozzle diameter of 1 mm, a nozzle length of 1 mm, a load of 30 kg, and a rate of temperature rise of 3° C./min.

Subsequently, 100 parts by weight of the resultant styrene-acryl modified polyester resin, 2.5 parts by weight of organic pigment (LIONOL TELLOW FG-1310 commercially available from Toyo Ink Mfg.Co., Ltd.) and 2 parts by weight of the carboxylate compound of the chemical formula (30), as the charge control agent, were sufficiently blended by a Henschell mixer and kneaded by a twin-screw extruder. The resultant mixture was cooled and then crushed by a feather mill. The resultant particles were pulverized by a jet mill and subject to air classification thereby to give toner particles having an average particle size of 8 μm.

To 100 parts by weight of the resultant toner particles, there were added 0.3 parts by weight of hydrophobic silica (H-2000/4 commercially available from Wacker) and 0.5 parts by weight of hydrophobic titanium oxide (T-805 commercially available from Degussa AG). The resultant mixture was blended by a Henschell mixer (commercially available from Mitsui-Miike Kakoki K.K.) at revs of 1500 rpm for 1 minute and thus was obtained a toner of Example 11.

(EXAMPLE 12)

In this example, 100 parts by weight of monodisperse spherical polymer particles having an average particle size of 6 μm (glass transition temp.: 54° C., softening point: 128° C., gelling component: containing 15% of component insoluble to toluene) obtained by copolymerizing styrene and n-butylmethacrylate by seed polymerization process, and 8 parts by weight of carbon black (MA#8 commercially available from Mitsubishi Kagaku Corp.) were thrown in a 10-litter Henschell mixer (commercially available from Mitsui-Miike Kakoki K.K.) to be blended by agitating at revs of 1000 rpm for 2 minutes. Thus, the carbon black was made to adhere to the surfaces of the polymer particles.

The resultant polymer particles were processed at revs of 6000 rpm for 3 minutes by a hybridization system (NHS-1 commercially available from Nara Machines Co., Ltd.) thereby to fix the carbon black to the surfaces of the polymer particles.

Subsequently, 100 parts by weight of the aforesaid polymer particles and 10 parts by weight of MMA/iBMA (1/9)

particles having an average particle size of 0.2 μm and a glass transition temperature of 85° C. (MP-4951 commercially available from Soken Chemical Co., Ltd.) were processed at revs of 8000 rpm for 5 minutes by the aforesaid hybridization system, thereby forming a resin coat layer on the surfaces of the polymer particles.

To 100 parts by weight of the polymer particles with the resin coat layer, there was added 2 parts by weight of the carboxylate compound of the chemical formula (33), as the charge control agent, for fixing the charge control agent on the surfaces of the polymer particles in a similar manner to the aforesaid carbon black. Thus were obtained toner particles having an average particle size of 6.5 μm.

Subsequently, 0.5 parts by weight of hydrophobic silica (H-2000 commercially available from Wacker) was added to 100 parts by weight of the resultant toner particles. The mixture was processed at revs of 1500 rpm for 1 minute by a Henschell mixer thereby to give a toner of Example 12.

(EXAMPLE 13)

In this example, 60 parts by weight of 2,2'-bis[P-(2-hydroxy)-phenyl]propane, 20 parts by weight of isophthal, and 0.1 part by weight of dibutyltin oxide were put in a flask and allowed to react in an atmosphere of nitrogen at 230° C. for 24 hours thereby giving a polyester resin having a weight average molecular weight Mw of 7000.

Subsequently, 50 parts by weight of the polyester resin was dissolved in 50 parts by weight of xylene in a flask, wherein the resultant mixture solution of xylene was heated at reflux while a solution comprising 13 parts by weight of styrene, 0.3 parts by weight of diethylaminoethyl methacrylate and 0.4 parts by weight of azobisisobutyronitrile was added thereto dropwise for about 30 minutes in an atmosphere of nitrogen. After maintained at a constant high temperature for 3 hours, the xylene was distilled in vacuo to give amino-modified polyester resin. The amino-modified polyester resin had a weight average molecular weight Mw of 11000, a ratio of weight average molecular weight Mw to number average molecular weight Mn (Mw/Mn) of 3.0, a melt viscosity of $5\times10^4$ poise at 100° C., and a glass transition temperature of 61° C.

Subsequently, 100 parts by weight of the resultant amino-modified polyester resin, 2.5 parts by weight of organic pigment (LIONOL RED 6B FG-3213 commercially available from Toyo Ink Mfg.Co., Ltd.) and 2.0 parts by weight of the carboxylate compound of the chemical formula (38), as the charge control agent, were sufficiently blended by a Henschell mixer and kneaded by a twin-screw extruder. The resultant mixture was cooled and then crushed by a feather mill. The resultant particles were pulverized by a jet mill and subject to air classification thereby to give toner particles having an average particle size of 8 μm.

Then 0.5 parts by weight of hydrophobic silica (H-2000 commercially available from Wacker)was added to 100 parts by weight of the resultant toner particles. The mixture was blended by a Henschell mixer (commercially available from Mitsui-Miike Kakoki K.K.) at revs of 1500 rpm for 1 minute and thus was obtained a toner of Example 13.

(EXAMPLE 14)

In this example, 160 g of styrene, 90 g of butylmethacrylate, 30 g of isobutylacrylate, 3 g of α-methylstyrene dimer (NOFMER MSD commercially available from Nippon Yushi K.K.), 2 g of silane coupling agent (TSL8311 commercially available from Toshiba Corporation) and 6 g of 2,2'-azobis(2,4-dimethylvaleronitrile) were uniformly blended and dispersed by a homojetter (commercially available from Tokushu Machine Co., Ltd.).

By using, as a dispersion stabilizer, 60 g of 4% solution of methyl cellulose (METHCELL K35LV commercially available from Dow Chemical Co.) and 5 g of 1% solution of dioctyl sulfosuccinate soda (NIKKOL OTP-75 commercially available from Nikko Chemical Co., Ltd.), the aforesaid fluid dispersion was suspended in an aqueous solution comprising 0.3 g of hexametaphosphate soda (Wako Pharmaceutical K.K.) dissolved in 650 g of deionized water by means of a homojetter.

Next, this suspension was transferred to a 4-neck flask, the air in which was replaced by nitrogen. Subsequently, the suspension was agitated at 50° C. and revs of 100 rpm for 24 hours for polymerization thereby to give resin particles. The resultant resin particles were repeatedly filtered off and washed and thereafter, were dried.

Subsequently, 100 parts by weight of the resultant resin particles, 8 parts by weight of carbon black of pH 3 (MA#8 commercially available from Mitsubishi Kagaku Corp.), 4 parts by weight of low-molecular-weight polypropylene (660P commercially available from Sanyo Chemical Industries Ltd.), and 2 parts by weight of the carboxyalte compound of the chemical formula (49), as the charge control agent, were sufficiently blended by a Henschell mixer and kneaded by a twin-screw extruder. The resultant mixture was cooled and crushed by a feather mill. The resultant particles were pulverized by a jet mill and subject to air classification to give toner particles having an average particle size of 8 μm.

Subsequently, 0.5 parts by weight of hydrophobic silica (T-500 commercially available from Tokyo Materials Co., Ltd.) was added to 100 parts by weight of the toner particles. The mixture was processed by a Henschell mixer at revs of 1500 rpm for 1 minute thereby to give a toner of Example 14. The toner had a glass transition point Tg of 56° C., a softening point Tm of 87° C., and an onset run-off temperature of 78° C. as measured by a flow tester during the temperature rise. Incidentally, the softening point Tm was measured by means of a perfect oven.

(EXAMPLE 15)

In this example, a material comprising 10 parts by weight of glycidyl methacrylate, 60 parts by weight of styrene, 30 parts by weight of butyl methacrylate, and 5 parts by weight of benzoyl peroxide together with a deionized water containing 0.1 wt % of polyvinyl alcohol were thrown in a reaction vessel equipped with an agitator, an inert gas inlet tube, a reflux condenser tube and a thermometer. The mixture was sufficiently blended and dispersed, and the resultant dispersion was further vigorously agitated to give a uniform suspension.

Next, the suspension was heated to 80° C. with nitrogen gas bubbled into the reaction vessel. The agitation was continued at this temperature for 5 hours for polymerization reaction. Subsequently, the water was removed to obtain a polymer having an epoxy group as a reactive group.

Then, 100 parts by weight of the resultant polymer, 40 parts by weight of carbon black of pH 3.5 (MA-1OOR commercially available from Mitsubishi Kagaku Corp.), and 5 parts by weight of low-molecular-weight polypropylene (VISCOL 605P commercially available from Sanyo Chemical Industries Ltd.) were mixed together. The mixture was kneaded at 160° C. by a pressure kneader for reaction. The reaction product was cooled and ground to obtain graft polymer containing a colorant comprising a wax-containing carbon black.

A polymerizable monomer solution comprising 80 parts by weight of styrene and 20 parts by weight of n-butyl acrylate which were preliminarily dissolved in deionized water containing 0.5 wt % of sodium dodecylbenzenesulfonate as an anionic surface-active agent was mixed with 50 parts by weight of the aforesaid graft polymer, 3 parts by weight of azobisisobutyronitrile and 3 parts by weight of 2,2'-azobis-(2,4-dimethylvaleronitrile). The resultant mixture was thrown in the same reaction vessel as that aforementioned so as to be blended and agitated by T.K.Homomixer (commercially available from Tokushu Machine Co., Ltd.) and thus was obtained a uniform suspension.

Next, the suspension was heated to 65° C. with nitrogen gas bubbled into the reaction vessel. At this temperature, the agitation was continued for 5 hours for suspension polymerization reaction and then the suspension was further heated to 75° C. to complete the polymerization reaction.

A solution comprising 2 parts by weight of hydrophobic silica (H-2000 commercially available from Wacker) and 2 parts by weight of silane coupling agent (TSL8311 commercially available from Toshiba Silicone Co., Ltd.) dispersed in methyl alcohol was added to the aforesaid suspension to be blended therewith. Subsequently, the resultant suspension was heated at 80° C. for 1 hour thereby allowing the suspended particles to fusion bond one another and thus was obtained block-like suspension polymerization agglomeration.

The suspension polymerization agglomeration was repeatedly filtered off and washed with water. Then the suspension polymerization agglomeration was hot-air dried at 60° C. and 80 RH % for 5 hours by means of a hot-air dryer and then further hot-air dried at 50° C. and 50 RH % for 5 hours.

Subsequently, 100 parts by weight of the resultant suspension polymerization agglomeration was mixed with 1.0 part by weight of the carboxylate compound of the chemical formula (30), as the charge control agent, 0.3 parts by weight of hydrophobic silica (H-2000 commercially available from Wacker), and 0.5 parts by weight of tin oxide particulates (T-1 commercially available from Mitsubishi Materials Co., Ltd.). The mixture was blended and agitated by a Henschell mixer (commercially available from Mitsui-Miike Kakoki K.K.) at revs of 3000 rpm. Thereafter, the mixture was subject to crushing process at revs of 18000 rpm by means of Criptron system (KTM-XL model commercially available from Kawasaki Heavy Industries Ltd.) with inlet air temperature through its inlet port set at 0° C. Thus were obtained toner particles having an average particle size of 6.0 μm. Incidentally, the temperature of air discharged during this process was 28° C.

Subsequently, 0.2 parts by weight of hydrophobic silica (H-2000 commercially available from Wacker) was added to 100 parts by weight of the resultant toner particles and the mixture was processed at revs of 1500 rpm for 1 minute by a Henschell mixer (commercially available from Mitsui-Miike Kakoki K.K.) thereby to give a toner of Example 15.

(EXAMPLE 16)

In this example, 60 g of styrene, 35 g of n-butyl methacrylate, 5 g of methacrylate, 0.5 g of 2,2'-azobis-(2,4-dimethylvaleronitrile), and 3 g of low-molecular-weight polypropylene (VISCOL 605P commercially available from Sanyo Chemical Industries Ltd.) were blended by a sand stirrer to prepare a polymerizable composition.

The resultant composition was agitated in a 3% aqueous solution of acacia gum by a mixer (TK Auto-homomixer commercially available from Tokushu Machine Co., Ltd.) at revs of 4000 rpm, thus allowed for polymerization reaction at 60° C. for 6 hours thereby to give spherical suspension-polymerized particles having an average particle size of 6 μm.

Then, a dispersion solution comprising 10 g of black disperse dye (KAYARON PREESTER BLACK S-CONC commercially available from Nippon Kayaku Co., Ltd.) dispersed in 100 ml of pure water was added to the fluid dispersion incorporating the suspension-polymerized particles. The resultant mixture was vigorously agitated by a supersonic vibrator used in combination while heated to 75° C. at a rate of temperature raise of 2° C./min. The mixture was maintained in this state for 1 hour thereby to bind the black disperse dye to the suspension-polymerized particles.

Subsequently, the fluid dispersion was cooled and the aforementioned suspension-polymerized particles with the black disperse dye bound thereto were repeatedly filtered off and washed with water. Thereafter, the resultant suspension-polymerized particles were dried by a slurry dryer (Dispercoat commercially available from Nisshin Engineering Co., Ltd.) and then subject to air classification to give toner particles having an average particle size of 7 μm.

Subsequently, 1.0 part by weight of the carboxylate compound of the chemical formula (57), as the charge control agent, and 0.5 parts by weight of hydrophobic alumina (RFY-C commercially available from Nippon Aerosil Co., Ltd.) were added to 100 parts by weight of the toner particles. The mixture was sufficiently blended and agitated and then, subjected to fixing process by a hybridization system (NHS-O model commercially available from Nara Machines Co., Ltd.) at a circumferential speed of 60 m/sec.

Next, 0.1 part by weight of hydrophobic silica (R-974 commercially available from Nippon Aerosil Co., Ltd.) having an average particle size of 17 nm was added to 100 parts by weight of the resultant product. The mixture was processed by a Henschell mixer (Mitsui-Miike Kakoki K.K.) at revs of 1000 rpm for 1 minute thereby to give a toner of Example 16.

(EXAMPLE 17)

In this example, 100 g of polyester resin (NE-382 commercially available from Kao Soap Co., Ltd.) was dissolved into 400 g of mixture solvent comprising methylene chloride and toluene at the ratio of 8/2. The resultant mixture solution and 5 g of phthalocyanine pigment were thrown in a ball mill to be subject to 3 hours' blending process, thereby giving a fluid dispersion with the phthalocyanine pigment uniformly dispersed therein.

Next, the resultant fluid dispersion was added to a mixture solution comprising 60 g of 4% solution of methyl cellulose (METHCELL K35LV commercially available from Dow Chemical Co.), 5 g of 1% solution of dioctyl sulfosuccinate soda (NIKKOL OTP75 commercially available from Nikko Chemical Co., Ltd.), as the dispersion stabilizer, and an aqueous solution comprising 0.5 g of hexametaphosphate soda (commercially available from Wako Pharmaceutical K.K.) dissolved in 1000 g of deionized water. The resultant mixture solution was agitated by TK Auto-homomixer (commercially available from Tokushu Machine Co., Ltd.) with its revolution speed adjusted for suspension polymerization, thereby to give suspension-polymerized particles having an average particle size of 3 to 10 μm.

The resultant suspension-polymerized particles were repeatedly filtered off and washed with water and then, (dried by a slurry drier (DISPEROAT commercially available from Nisshin Engineering Co., Ltd.). The particles thus dried were subject to air classification thereby to give toner particles having an average particle size of 6 μm.

Subsequently, 0.5 parts by weight of the carboxylate compound of the chemical formula (60), as the charge control agent, and 0.3 parts by weight of hydrophobic silica (H-2000/4 commercially available from Wacker) were added to 100 parts by weight of the toner particles. The mixture was blended by a Henschell mixer at revs of 3000 rpm for 2 minutes and thereafter, subject to fixing process by a hybridization system (NHS-O model commercially available from Nara Machines Co., Ltd.) at a circumferential speed of 60 m/sec.

Next, 0.3 parts by weight of hydrophobic silica (H-2000/4 commercially available from Wacker) and 0.5 parts by weight of hydrophobic titanium oxide (T-805 commercially available from Nippon Aerosil Co., Ltd.) were added to 100 parts by weight of the aforesaid processed product. The mixture was processed by a Henschell mixer (commercially available from Mitsui-Miike Kakoki K.K.) at revs of 1500 rpm for 1 minute thereby to give a toner of Example 17.

(COMPARATIVE EXAMPLE 1)

A toner of Comparative Example 1 having an average particle size of 8 μm was prepared in the same manner as in Example 1, except for that the charge control agent of the carboxylate compound of the chemical formula (4) used in Example 1 was not added.

(COMPARATIVE EXAMPLE 2)

A toner of Comparative Example 2 having an average particle size of 8 μm was prepared in the same manner as in Example 1, except for that the charge control agent of the carboxylate compound of the chemical formula (4) used in Example 1 was replaced by di-tert-butylated hydroxytoluene of the following chemical formula (102), as shown in the following Table 1.

(102)

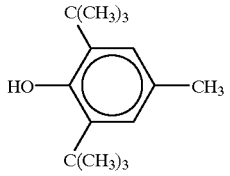

(COMPARATIVE EXAMPLE 3)

A toner of Comparative Example 3 having an average particle size of 8 μm was prepared in the same manner as in Example 1, except for that the charge control agent of the carboxylate compound of the chemical formula (4) used in Example 1 was replaced by 3 parts by weight of chromic complex dye (S-34 commercially available from Orient Chemical Co., Ltd.), as shown in the following Table 1.

(COMPARATIVE EXAMPLE 4)

A toner of Comparative Example 4 having an average particle size of 8 μm was prepared in the same manner as in Example 1, except for that the charge control agent of the carboxylate compound of the chemical formula (4) used in Example 1 was replaced by bisphenol A, as shown in the following Table 1.

(COMPARATIVE EXAMPLE 5)

A toner of Comparative Example 5 having an average particle size of 8 μm was prepared in the same manner as in Example 1, except for that the charge control agent of the carboxylate compound of the chemical formula (4) used in Example 1 was replaced by a carboxylate compound of the following chemical formula (103), as shown in the following Table 1.

(103)

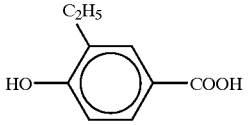

TABLE 1

| Toner | Type of Charge Control Agent |
|---|---|
| Ex.1 | Carboxylate compound of formula (4) |
| Ex.2 | Carboxylate compound of formula (5) |
| Ex.3 | Carboxylate compound of formula (6) |
| Ex.4 | Carboxylate compound of formula (7) |
| Ex.5 | Carboxylate compound of formula (10) |
| Ex.6 | Carboxylate compound of formula (14) |
| Ex.7 | Carboxylate compound of formula (17) |
| Ex.8 | Carboxylate compound of formula (22) |
| Ex.9 | Carboxylate compound of formula (25) |
| Ex.10 | Carboxylate compound of formula (28) |
| Ex.11 | Carboxylate compound of formula (30) |
| Ex.12 | Carboxylate compound of formula (33) |
| Ex.13 | Carboxylate compound of formula (38) |
| Ex.14 | Carboxylate compound of formula (49) |
| Ex.15 | Carboxylate compound of formula (30) |
| Ex.16 | Carboxylate compound of formula (57) |
| Ex.17 | Carboxylate compound of formula (60) |
| C.Ex.1 | Not used |
| C.Ex.2 | Di-tert-butylated hydroxytoluene |
| C.Ex.3 | Chromic complex dye of formula (102) |
| C.Ex.4 | Bisphenol A |
| C.Ex.5 | Carboxylate compound of formula (103) |

(EXAMPLES 18 TO 21)

Toners of Examples 18 to 21 were prepared in the same manner as in Example 1, except for that the charge control agent used in Example 1 was replaced by the ascorbate compound of the chemical formula (70) in Example 18, by the ascorbate compound of the chemical formula (71) in Example 19, by the ascrobate compound of the chemical formula (72) in Example 20 and by the ascorbate compound of the chemical formula (73) in Example 21, respectively, as shown in the following Table 2.

(EXAMPLES 22 TO 25)

Toners of Examples 22 to 25 were prepared in the same manner as in Example 5, except for that the charge control agent used in Example 5 was replaced by the ascorbate compound of the chemical formula (76) in Example 22, by the ascorbate compound of the chemical formula (78) in Example 23, by the ascrobate compound of the chemical formula (79) in Example 24 and by the ascorbate compound of the chemical formula (74) in Example 25, respectively, as shown in the following Table 2.

(EXAMPLE 26)

A toner of Example 26 was prepared in the same manner as in Example 9, except for that the charge control agent used in Example 9 was replaced by the ascorbate compound of the chemical formula (86), as shown in the following Table 2.

(EXAMPLE 27)

A toner of Example 27 was prepared in the same manner as in Example 10, except for that the charge control agent used in Example 10 was replaced by the ascorbate compound of the chemical formula (70), as shown in the following Table 2.

(EXAMPLE 28)

A toner of Example 28 was prepared in the same manner as in Example 11, except for that the charge control agent used in Example 11 was replaced by the ascorbate compound of the chemical formula (87), as shown in the following Table 2.

(EXAMPLE 29)

A toner of Example 29 was prepared in the same manner as in Example 12, except for that the charge control agent used in Example 12 was replaced by the ascorbate compound of the chemical formula (88), as shown in the following Table 2.

(EXAMPLE 30)

A toner of Example 30 was prepared in the same manner as in Example 13, except for that the charge control agent used in Example 13 was replaced by the ascorbate compound of the chemical formula (89), as shown in the following Table 2.

(EXAMPLE 31)

A toner of Example 31 was prepared in the same manner as in Example 14, except for that the charge control agent used in Example 14 was replaced by the ascorbate compound of the chemical formula (91), as shown in the following Table 2.

(EXAMPLE 32)

A toner of Example 32 was prepared in the same manner as in Example 15, except for that the charge control agent used in Example 15 was replaced by the ascorbate compound of the chemical formula (93), as shown in the following Table 2.

(EXAMPLE 33)

A toner of Example 33 was prepared in the same manner as in Example 16, except for that the charge control agent used in Example 16 was replaced by the ascorbate compound of the chemical formula (94), as shown in the following Table 2.

(EXAMPLE 34)

A toner of Example 34 was prepared in the same manner as in Example 17, except for that the charge control agent used in Example 17 was replaced by the ascorbate compound of the chemical formula (98), as shown in the following Table 2.

TABLE 2

| Toner | Type of Charge Control Agent |
|---|---|
| Ex.18 | Ascorbate compound of formula (70) |
| Ex.19 | Ascorbate compound of formula (71) |
| Ex.20 | Ascorbate compound of formula (72) |
| Ex.21 | Ascorbate compound of formula (73) |
| Ex.22 | Ascorbate compound of formula (76) |
| Ex.23 | Ascorbate compound of formula (78) |
| Ex.24 | Ascorbate compound of formula (79) |
| Ex.25 | Ascorbate compound of formula (74) |
| Ex.26 | Ascorbate compound of formula (86) |
| Ex.27 | Ascorbate compound of formula (80) |
| Ex.28 | Ascorbate compound of formula (87) |
| Ex.29 | Ascorbate compound of formula (88) |
| Ex.30 | Ascorbate compound of formula (89) |
| Ex.31 | Ascorbate compound of formula (91) |
| Ex.32 | Ascorbate compound of formula (93) |
| Ex.33 | Ascorbate compound of formula (94) |
| Ex.34 | Ascorbate compound of formula (98) |

There were prepared 4 types of carriers A to D to be blended with the toners for developing electrostatic latent images obtained in the aforesaid Examples and Comparative Examples.

(PREPARATION OF CARRIER A)

100 parts by weight of polyester resin (NE-1110 commercially available from Kao Soap Co., Ltd.), 600 parts by weight of inorganic magnetic powder (MFP-2 commercially available from TDK Corporation), and 2 parts by weight of carbon black (MA#8 commercially available from Mitsubishi Kagaku Corporation) were sufficiently blended and ground by a Henschell mixer.

The resultant particles were melt kneaded by a extruder/kneader with its cylinder body set at 180° C. and its cylinder head set at 170° C. The resultant mixture was cooled, crushed and further pulverized by a jet mill. The resultant particles were subject to air classification to give binder-type carrier particles A having an average particle size of 55$\mu$m.

(PREPARATION OF CARRIER B)

The surfaces of ferrite carrier cores (F-300 commercially available from Powder Tech Corporation) were coated with thermosetting silicone resin by means of a rotary fluidizer tank (Spiller Coater commercially available from Okada Machines Co., Ltd.) and thus were obtained carrier particles B having an average particle size of 50 $\mu$m.

(PREPARATION OF CARRIER C)

The surfaces of ferrite carrier cores (F-300 commercially available from Powder Tech Corporation) were coated with polyethylene resin by a polymerization surface coating method and thus were obtained carrier particles C having an average particle size of 51 $\mu$m.

(PREPARATION OF CARRIER D)

The surfaces of ferrite carrier cores (F-300 commercially available from Powder Tech Corporation) were coated with thermosetting acryl-modified silicone resin by dip coating and thus were obtained carrier particles D having an average particle size of 50 $\mu$m.

The average particle size of each of the aforementioned toners was determined on the basis of the particle-size-based relative weight distribution determined by the use of Coulter Counter TA-II (commercially available from Coulter Counter Inc.) and an aperture tube of 100 $\mu$m.

On the other hand, the average particle size of each of the aforementioned carrier particles was determined by the use of SALD1100 (commercially available from Shimadzu Corporation).

As shown in the following Table 3, the toners of the aforementioned Examples 1 to 13 and 15 to 17 and of Comparative Examples 1 to 5, incorporating the carboxylate compound as the charge control agent, were combined with any one of the aforesaid carrier particles A to D, respectively. As shown in the following Table 4, the toners of the aforementioned Examples 18 to 30 and 32 to 34, incorporating the ascorbate compound as the charge control agent, were combined with any one of the aforementioned carrier particles A to D, respectively. The respective toners were blended with the respective carriers to form developers with a toner density thereof adjusted to 5 wt %.

Measurement of Amount of Toner Having Low Chargeability

As to each of the above developers, measurement was taken on the charge quantity of the toner and amount of toner having low chargeability.

In the measurement of the charge quantity of each toner, each of the developers was loaded in a rotary tumble blender to be blended and agitated for 30 minutes. Thereafter, a 1 g sample of each developer thus blended was taken by the use of a precision balance.

A device shown in FIG. 1 was used for this measurement. More specifically, each developer sample thus prepared was uniformly applied to the overall surface of a conductive sleeve 2 and a magnet roll 3 was set to the revs of 1000 rpm.

Next, 3 kV of bias voltage Vb of the same polarity with that of each toner was supplied from a bias supply 4. After 30 seconds' revolution of the above magnet roll 3, a potential Vm of a condenser 5 was read at the time when the magnet roll 3 was stopped, while a weight of toner adhered to a cylinder electrode 1 was measured by the use a precision balance, so that an average charge quantity of the toner in each developer was found. The average charge quantities of the toners thus found were summarized in Tables 3 and 4.

The measurement of the amount of toner having low chargeability was carried out in a similar manner to the above, except for that the conductive sleeve 2 was grounded instead of applying a bias voltage to the conductive sleeve 2 from the bias supply 4. There were found ratios of respective amounts of low-charged toner flown to the cylinder electrode 1 to the overall amounts of the respective toners on the conductive sleeve 2, so that each toner was rated on ○-to-X scale. More specifically, a toner containing less than 1 wt % of toner of low-chargeability was judged ○, a toner containing 1 to 2 wt % of toner of low-chargeability was judged Δ, and a toner containing more than 2 wt % of toner of low-chargeability was judged X, as shown in Table 3 and 4. It is to be noted that the judgments of ○ and Δ mean an acceptable ratio of the low-charged toner.

As to the respective toners of the aforesaid developers and of Examples 14 and 31, the charge stability thereof in environmental changes was examined.

In the examination of the charge stability of each toner, there were measured charge quantities ($Q_{L/L}$) of the respective toners of the aforesaid developers and of Examples 14 and 31 having been allowed to stand for 24 hours under conditions (L/L environment) of 5° C. in ambient temperature and 15% in relative humidity; charge quantities ($Q_{H/H}$) of the same having been allowed to stand for 24 hours under conditions (H/H environment) of 35° C. in ambient temperature and 85% in relative humidity; and charge quantities ($Q_{N/N}$) of the same having been allowed to stand for 24 hours under conditions (N/N environment) of 23° C. in ambient temperature and 55% in relative humidity.

Then, the following values A and B were calculated based on the following equations. A toner presenting both values of A and B smaller than 15% was judged ○, a toner presenting either of the values of A and B not smaller than 15% was judged Δ, and a toner presenting both values of A and B not smaller than 15% was judged X. It is to be noted that the judgments of ○ and Δ mean acceptable charge stability in the environmental changes.

$$A(\%)=|(Q_{L/L}-Q_{N/N})/(Q_{N/N})|\times 100$$

$$B(\%)=|(Q_{N/N}-Q_{H/H})/(Q_{N/N})|\times 100$$

Next, each of the aforesaid developers and the toners of Examples 14 and 31 was loaded in an image forming apparatus to form an image of an original document having a ratio of black to white (B/W ratio) at 6%. At the production of a first copy and a 10000-th copy, each of the resultant images was visually inspected to judge the presence of toner fogs in a white area and the results are shown in the following Tables 3 and 4. As to the presence of toner fogs, a copy suffering no toner fogs was judged ○, a copy acceptable in practical use despite some degrees of toner fogs was judged Δ, and a copy suffering heavy toner fogs was judged X as unacceptable in practical use.

Incidentally, the toners of Examples 1 to 19 and 18 to 26 and of Comparative Examples 1 to 5 were each applied to Minolta's copier EP-570Z™, the toners of Examples 10 to 13, 17, 27 to 29 and 34 were each applied to Minolta's digital full-color copier CF-80™, the toners of Examples 14 and 31 were each applied to Minolta's printer SP-101™, and the toners of Examples 15 and 32 were each applied to Minolta's printer SP-500™, for the image forming process. Further, Minolta's digital full-color copier CF-80™ is of a type wherein a separator oil is applied to the surface of a fixing roller whereas Minolta's printer SP-101™ features a fixing temperature of 130° C.

TABLE 3

| Toner | Carrier | Toner Charge Quantity (μC/g) | Amount of Toner of Low chargeability | Stability against Environmental Changes | Toner Fog 1st | Toner Fog 10000th |
|---|---|---|---|---|---|---|
| Ex.1 | A | −26 | ○ | ○ | ○ | ○ |
| Ex.2 | A | −25 | ○ | ○ | ○ | ○ |
| Ex.3 | A | −27 | ○ | ○ | ○ | ○ |
| Ex.4 | A | −27 | ○ | ○ | ○ | ○ |
| Ex.5 | A | −26 | ○ | ○ | ○ | ○ |
| Ex.6 | A | −28 | ○ | ○ | ○ | ○ |
| Ex.7 | A | −27 | ○ | ○ | ○ | ○ |
| Ex.8 | A | −28 | ○ | ○ | ○ | ○ |
| Ex.9 | A | −27 | ○ | ○ | ○ | ○ |
| Ex.10 | A | −28 | ○ | ○ | ○ | — |
| Ex.11 | D | −27 | ○ | ○ | ○ | — |
| Ex.12 | D | −29 | ○ | ○ | ○ | — |
| Ex.13 | B | −29 | ○ | ○ | ○ | — |
| Ex.14 | — | — | — | ○ | ○ | — |
| Ex.15 | C | −29 | ○ | ○ | ○ | ○ |
| Ex.16 | A | −28 | ○ | ○ | ○ | — |
| Ex.17 | D | −27 | ○ | ○ | ○ | — |
| C.Ex.1 | A | −13 | X | — | X | — |

TABLE 3-continued

| Toner | Carrier | Toner Charge Quantity (μC/g) | Amount of Toner of Low chargeability | Stability against Environmental Changes | Toner Fog 1st | Toner Fog 10000th |
|---|---|---|---|---|---|---|
| C.Ex.2 | A | −16 | X | — | X | X |
| C.Ex.3 | A | −18 | Δ | X | Δ | X |
| C.Ex.4 | A | −14 | X | — | X | — |
| C.Ex.5 | A | −15 | X | — | X | — |

TABLE 4

| Toner | Carrier | Toner Charge Quantity (μC/g) | Amount of Toner of Low chargeability | Stability against Environmental Changes | Toner Fog 1st | Toner Fog 10000th |
|---|---|---|---|---|---|---|
| Ex.18 | A | −23 | ○ | ○ | ○ | ○ |
| Ex.19 | A | −25 | ○ | ○ | ○ | ○ |
| Ex.20 | A | −25 | ○ | ○ | ○ | ○ |
| Ex.21 | A | −23 | ○ | ○ | ○ | ○ |
| Ex.22 | A | −26 | ○ | ○ | ○ | ○ |
| Ex.23 | A | −23 | ○ | ○ | ○ | ○ |
| Ex.24 | A | −25 | ○ | ○ | ○ | ○ |
| Ex.25 | A | −30 | ○ | ○ | ○ | ○ |
| Ex.26 | A | −25 | ○ | ○ | ○ | ○ |
| Ex.27 | A | −26 | ○ | ○ | ○ | — |
| Ex.28 | D | −27 | ○ | ○ | ○ | — |
| Ex.29 | D | −32 | ○ | ○ | ○ | — |
| Ex.30 | B | −24 | ○ | ○ | ○ | — |
| Ex.31 | — | — | — | ○ | ○ | — |
| Ex.32 | C | −28 | ○ | ○ | ○ | ○ |
| Ex.33 | A | −27 | ○ | ○ | ○ | — |
| Ex.34 | D | −31 | ○ | ○ | ○ | — |

The results show that the toners for developing electrostatic latent images of Examples 1 to 34, each comprising, as the charge control agent, the carboxylate compound or ascorbate compound free from heavy metal, generally surpass the toners for developing electrostatic latent images of Comparative Example 1 free from the charge control agent and of Comparative Examples 2 to 5 comprising other charge control agents, in terms of quick start of charging, charge stability, spent-resistance and insusceptibility to environmental changes. In addition, the toners of the above Examples present excellent color reproducibility and light transmitting property.

Although the present invention has been fully described by way of example, it is to be noted that various changes and modification will be apparent to those skilled in the art.

Therefore, unless otherwise such changes and modifications depart from the scope of the present invention, they should be construed as being included therein.

What is claimed is:

1. A toner for developing electrostatic latent images comprising:

a binder resin;

a colorant; and a charge control agent comprising a carboxylate compound represented by the following general formula (I):

(I)

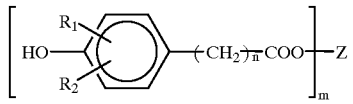

wherein $R_1$ is a halogen atom; $R_2$ is a halogen atom; Z is selected from the group consisting of an alkyl group, an alkylene group, an aryl group, an arylene group, and a heterocyclic group; n is an integer of from 0 to 2; and m is an integer of from 1 or 2.

2. A toner for developing electrostatic latent images as set forth in claim 1, wherein said toner comprises toner particles which contain the binder resin and the colorant.

3. A toner for developing electrostatic latent images as set forth in claim 2, wherein said carboxylate compound adheres to the surface of said toner particle.

4. A toner for developing electrostatic latent images as set forth in claim 2, wherein said carboxylate compound is incorporated in the toner particles.

5. A toner for developing electrostatic latent images as set forth in claim 2, wherein the toner particles have a resin coat layer comprising said carboxylate compound.

6. A toner for developing electrostatic latent images as set forth in claim 2, wherein said toner particle is a suspension-polymerized particle comprising a graft polymer containing carbon black and wherein said carboxylate compound adheres to the surface of said suspension-polymerized particle.

7. A toner for developing electrostatic latent images as set forth in claim 1, wherein said binder resin is selected from the group consisting of styrene resins, (meth)acrylic resins, olefin resins, amide resins, carbonate resins, polyether resins, polysulfone resins, epoxy resin, and copolymers and polymer blends thereof.

8. A toner for developing electrostatic latent images as set forth in claim 1, further comprising an anti-offset agent.

9. A toner for developing electrostatic latent images as set forth in claim 1, further comprising a fluidizing agent.

10. A toner for developing electrostatic latent images as set forth in claim 1, further comprising a cleaning assistant.

11. A toner for developing electrostatic latent images comprising:

toner particles being suspension-polymerized particles which comprise a graft polymer containing carbon black;

a colorant; and a charge control agent adhering to the surface of the suspension-polymerized particles and comprising an ascorbate compound represented by the following general formula (II):

(II)

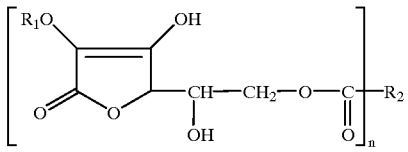

wherein $R_1$ is selected from the group consisting of a hydrogen atom and a $—COR_3$ group where $R_3$ is selected from the group consisting of an alkyl group, an aralkyl group and an aryl group which may have a substituent; $R_2$ is selected from the group consisting of an alkyl group, an aralkyl group, an aryl group, an alkylene group, an aralkylene group and an arylene group which may have a substituent; and n is an integer of 1 or 2.

12. A toner for developing electrostatic latent images as set forth in claim 11, further comprising an anti-offset agent.

13. A toner for developing electrostatic latent images as set forth in claim 11, further comprising a fluidizing agent.

14. A toner for developing electrostatic latent images as set forth in claim 11, further comprising a cleaning assistant.

15. A toner for developing electrostatic latent images comprising:

a binder resin;

a colorant; and a charge control agent comprising a carboxylate compound represented by the following general formula (III):

(III)

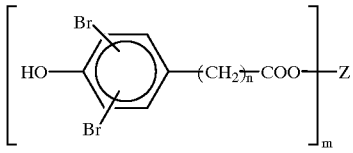

wherein Z is selected from the group consisting of an alkyl group, an alkylene group, an aryl group, an arylene group, and a heterocyclic group; n is an integer of from 0 to 2; and m is an integer of from 1 or 2.

* * * * *